US009414177B2

(12) United States Patent
Yoshizawa

(10) Patent No.: US 9,414,177 B2
(45) Date of Patent: Aug. 9, 2016

(54) AUDIO SIGNAL PROCESSING METHOD AND AUDIO SIGNAL PROCESSING DEVICE

(71) Applicant: Panasonic Intellectual Property Management Co., Ltd., Osaka (JP)

(72) Inventor: Shinichi Yoshizawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 74 days.

(21) Appl. No.: 14/553,623

(22) Filed: Nov. 25, 2014

(65) Prior Publication Data

US 2015/0146897 A1 May 28, 2015

(30) Foreign Application Priority Data

Nov. 27, 2013 (JP) ..... 2013-244519
Oct. 30, 2014 (JP) ..... 2014-221715

(51) Int. Cl.
*H04S 7/00* (2006.01)
*H04S 1/00* (2006.01)

(52) U.S. Cl.
CPC ..... *H04S 1/002* (2013.01); *H04R 2499/13* (2013.01)

(58) Field of Classification Search
None
See application file for complete search history.

(56) References Cited

U.S. PATENT DOCUMENTS

| | | | | |
|---|---|---|---|---|
| 8,391,498 | B2 | 3/2013 | Potard | |
| 2011/0194712 | A1 | 8/2011 | Potard | |
| 2013/0003998 | A1* | 1/2013 | Kirkeby | G05B 23/0235 381/300 |
| 2014/0072124 | A1* | 3/2014 | Stoecklmeier | H04S 1/007 381/27 |
| 2014/0247947 | A1 | 9/2014 | Yoshizawa et al. | |
| 2014/0270187 | A1* | 9/2014 | Hall | H04S 7/303 381/17 |

FOREIGN PATENT DOCUMENTS

| | | | |
|---|---|---|---|
| JP | 2006-303799 | A | 11/2006 |
| JP | 2011-512110 | A | 4/2011 |
| JP | 5248718 | B1 | 4/2013 |
| WO | 2009-102750 | A1 | 8/2009 |
| WO | 2013-094135 | A1 | 6/2013 |

* cited by examiner

*Primary Examiner* — Brenda Bernardi
(74) *Attorney, Agent, or Firm* — McDermott Will & Emery LLP

(57) ABSTRACT

An audio signal processing method includes: obtaining an L signal including a sound localized closer to the left as a major component and an R signal including a sound localized closer to the right as a major component; extracting a first signal which is a component of a sound included in the L signal and localized closer to the right and a second signal which is a component of a sound included in the R signal and localized closer to the left; generating a first output signal by subtracting the first signal from the L signal and adding the second signal to the L signal and a second output signal by subtracting the second signal from the R signal and adding the first signal to the R signal; and outputting the first output signal and the second output signal.

8 Claims, 21 Drawing Sheets

AUDIO SIGNAL PROCESSING METHOD AND AUDIO SIGNAL PROCESSING DEVICE

CROSS REFERENCE TO RELATED APPLICATION

The present application is based on and claims priority of Japanese Patent Applications No. 2013-244519 filed on Nov. 27, 2013, and No. 2014-221715 filed on Oct. 30, 2014. The entire disclosures of the above-identified applications, including the specifications, drawings and claims are incorporated herein by reference in their entirety.

FIELD

The present disclosure relates to an audio signal processing method and an audio signal processing device which change the localization position of a sound by performing signal processing on two audio signals.

BACKGROUND

There is a conventional technique for canceling a spatial crosstalk by using an L signal and an R signal which are audio signals of two channels (for example, see Patent Literature (PTL) 1). The technique is for widening the sound image of a reproduced sound by reducing a reproduced sound of a right-side speaker arriving at the left ear and a reproduced sound of a left-side speaker arriving at the right ear.

CITATION LIST

Patent Literature

[PTL 1] Japanese Unexamined Patent Application Publication No. 2006-303799

[PTL 2] Japanese Patent No. 5248718

SUMMARY

Technical Problem

The above technique cannot change the localization position of a sound localized by the reproduced sounds of two audio signals.

The present disclosure provides an audio signal processing method which can change the localization position of a sound localized by the reproduced sounds of two audio signals.

Solution to Problem

An audio signal processing method according to the present disclosure includes: obtaining a first audio signal and a second audio signal which represent a sound field between a first position and a second position, the first audio signal including a sound localized closer to the first position than to the second position as a major component, the second audio signal including a sound localized closer to the second position than to the first position as a major component; extracting a first signal and a second signal, the first signal being a component of a sound included in the first audio signal and localized closer to the second position than to the first position, the second signal being a component of a sound included in the second audio signal and localized closer to the first position than to the second position; generating (i) a first output signal by subtracting the first signal from the first audio signal and adding the second signal to the first audio signal, and (ii) a second output signal by subtracting the second signal from the second audio signal and adding the first signal to the second audio signal; and outputting the first output signal and the second output signal.

Advantageous Effects

An audio signal processing method according to the present disclosure can change the localization position of a sound localized by the reproduced sounds of two audio signals.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

Hereinafter, non-limiting embodiments will be described in details with reference to the Drawings. However, descriptions more detailed than necessary may be omitted. For example, detailed description of already well known matters or description of substantially identical configurations may be omitted. This is intended to avoid redundancy in the description below, and to facilitate understanding of those skilled in the art.

It is to be noted that the attached drawings and the following description are provided so that those skilled in the art can fully understand the present disclosure. Therefore, the drawings and description are not intended to limit the subject matter defined by the claims.

Embodiment 1

Figure 1:
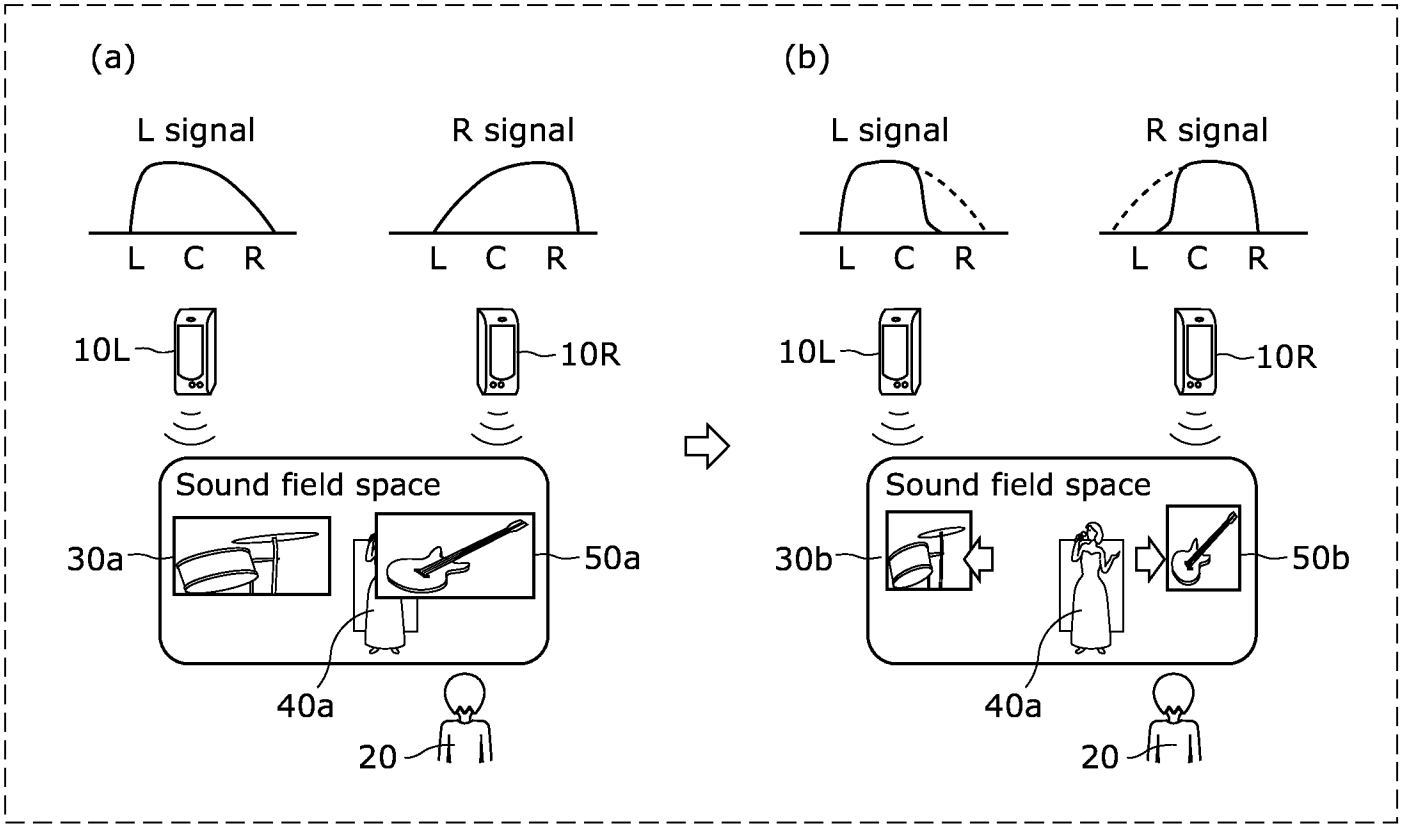
FIG. 1 is a schematic diagram for illustrating an outline of an audio signal processing method according to Embodiment 1.

First, an outline of an audio signal processing method according to Embodiment 1 will be described. FIG. 1 is a schematic diagram for illustrating an outline of the audio signal processing method.

In general, an L signal (L-channel signal) and an R signal (R-channel signal) included in a stereo signal include common components (sound components). Such common components have different signal levels depending on the localization position of a sound. In the example of (a) of FIG. 1, each of the L signal and the R signal includes components of a drum sound 30*a*, a vocal sound 40*a*, and a guitar sound 50*a*. The L signal has a higher signal level of a sound localized at the left side (drum sound 30*a*) and a lower signal level of a sound localized at the right side (guitar sound 50*a*). The R signal has a lower signal level of a sound localized at the left side (drum sound 30*a*) and a higher signal level of a sound localized at the right side (guitar sound 50*a*).

Reproduction of a stereo signal having such a configuration allows a listener to perceive a three-dimensional sound field.

However, the stereo signal is based on the assumption that the listener is present near the intermediate position between an L-channel speaker 10L and an R-channel speaker 10R. Hence, when the listening position is shifted, stereo perception may be reduced.

Specifically, for example, when the listening position of a listener 20 is closer to the R-channel speaker 10R than to the L-channel speaker 10L as illustrated in (a) of FIG. 1, the vocal sound 40*a* and the guitar sound 50*a* overlap for the listener 20, which may make it difficult to listen to the sound clearly. Moreover, in such a case, the localization of the guitar sound 50*a* and the drum sound 30*a* may be vague due to phase errors. A typical example of such a situation is inside a car. The position of the driver or the front passenger seat in the car is generally different from the intermediate position between two speakers.

Here, according to the audio signal processing method in Embodiment 1, as illustrated in (b) of FIG. 1, signal processing is performed on an L signal and an R signal such that the localization position of the drum sound 30*b* is moved toward the left side and the localization position of the guitar sound 50*b* is moved toward the right side. The localization position of the vocal sound 40*a* remains the same.

In this way, the listener 20 can listen to the vocal sound 40*a* clearly.

Hereinafter, details of the audio signal processing method (audio signal processing device) will be described.

[Example of Application]

Figure 2:
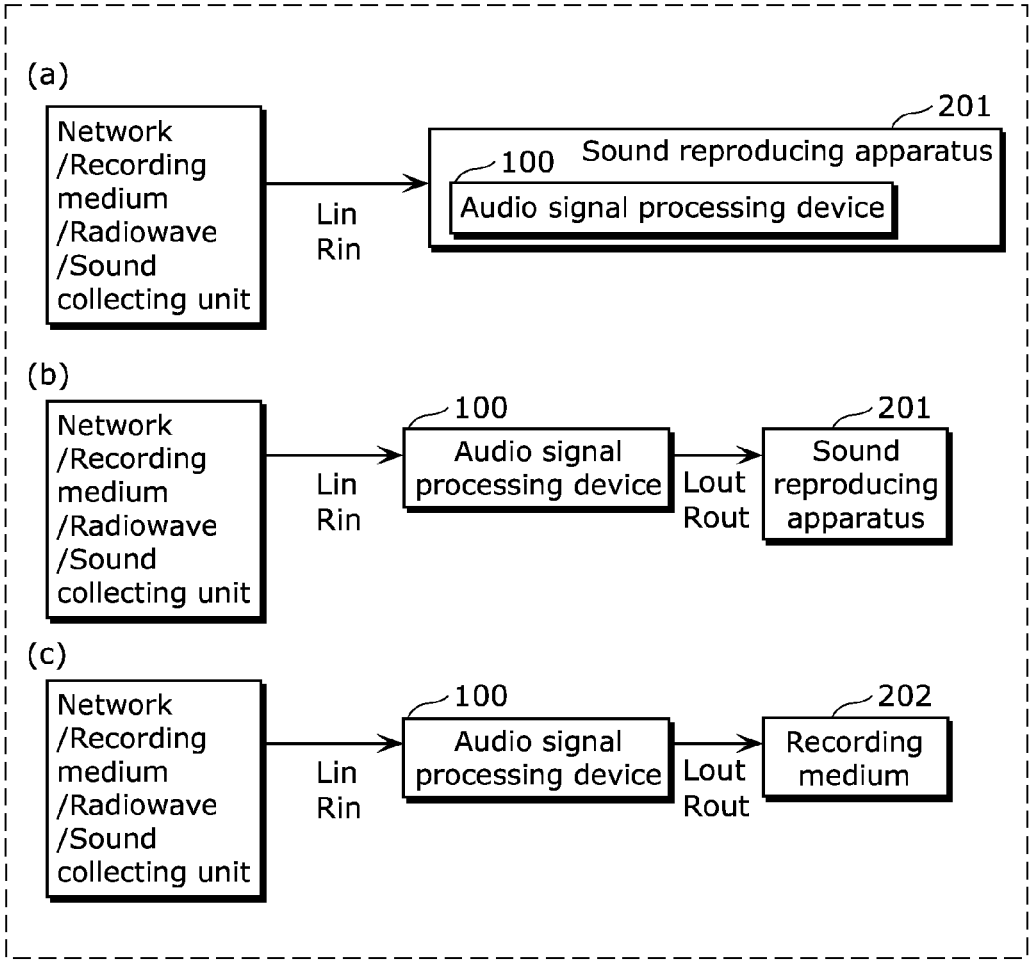
FIG. 2 illustrates examples of a configuration of an audio signal processing device and peripheral devices according to Embodiment 1.

First, an example of the application of the audio signal processing device according to Embodiment 1 will be described. FIG. 2 illustrates examples of a configuration of the audio signal processing device and peripheral devices according to Embodiment 1.

For example, as illustrated in (a) of FIG. 2, an audio signal processing device 100 according to Embodiment 1 is implemented as part of a sound reproducing apparatus 201. In such a case, the sound reproducing apparatus 201 (audio signal processing device 100) obtains two audio signals, an L signal and an R signal, from a network, a recording medium (storage medium), radiowave, a sound collecting unit, and the like. The L signal and the R signal are two signals included in a stereo signal.

The audio signal processing device 100 generates a first output signal (hereinafter, may also be referred to as Lout) and a second output signal (hereinafter, may also be referred to as Rout) based on the obtained two audio signals which are the L signal (hereinafter, may also be referred to as Lin) and the R signal (hereinafter, may also be referred to as Rin). Here, Lout and Rout respectively correspond to Lin and Rin, and are signals each having a sound localization position which has been changed. Specifically, Lout and Rout are reproduced by the reproduction system of the sound reproducing apparatus 201 including the audio signal processing device 100, so that a sound, having a localization position which has been changed, is output.

In the case of (a) of FIG. 2, examples of the audio signal processing device 100 include: an on-vehicle audio device; an audio device including a speaker such as a mobile audio device; a mini component; an audio device connected to a speaker such as an AV center amplifier; a television; a digital still camera; a digital video camera; a mobile terminal device; a personal computer; a TV conference system; a speaker; and a speaker system.

Moreover, as illustrated in (b) of FIG. 2, the audio signal processing device 100 may be implemented as a device separated from the sound reproducing apparatus 201. In such a case, the audio signal processing device 100 outputs Lout and Rout to the sound reproducing apparatus 201.

In this case, the audio signal processing device 100 is implemented as, for example, a server and a relay device of a network audio and the like, a mobile audio device, a mini component, an AV center amplifier, a television, a digital still camera, a digital video camera, a mobile terminal device, a personal computer, a TV conference system, a speaker, and a speaker system. An example of the separate sound reproducing apparatus 201 is an on-vehicle audio device.

As illustrated in (c) of FIG. 2, the audio signal processing device 100 may output (transmit) Lout and Rout to a recording medium 202. Specifically, the audio signal processing device 100 may record (store) Lout and Rout onto the recording medium 202.

Examples of the recording medium 202 include a packaged media such as a hard disk, a Blu-ray (registered trademark) disc, a digital versatile disc (DVD), and a compact disc (CD), and a flash memory. Such a recording medium 202 may be included in, for example, an on-vehicle audio device, a server and a relay device of a network audio and the like, a mobile audio device, a mini component, an AV center amplifier, a television, a digital still camera, a digital video camera, a mobile terminal device, a personal computer, a television conference system, a speaker, and a speaker system.

As described above, the audio signal processing device 100 may have any configuration as long as the audio signal processing device 100 has a function of obtaining Lin and Rin and generating Lout and Rout. Here, Lout has a desired sound localization position changed from the localization position of the obtained Lin, and Rout has a desired sound localization position changed from the localization position of the obtained Rin.

[Configuration and Operation]

Hereinafter, a specific configuration and an outline of an operation of the audio signal processing device 100 will be described referring to FIG. 3 and FIG. 4.

Figure 3:
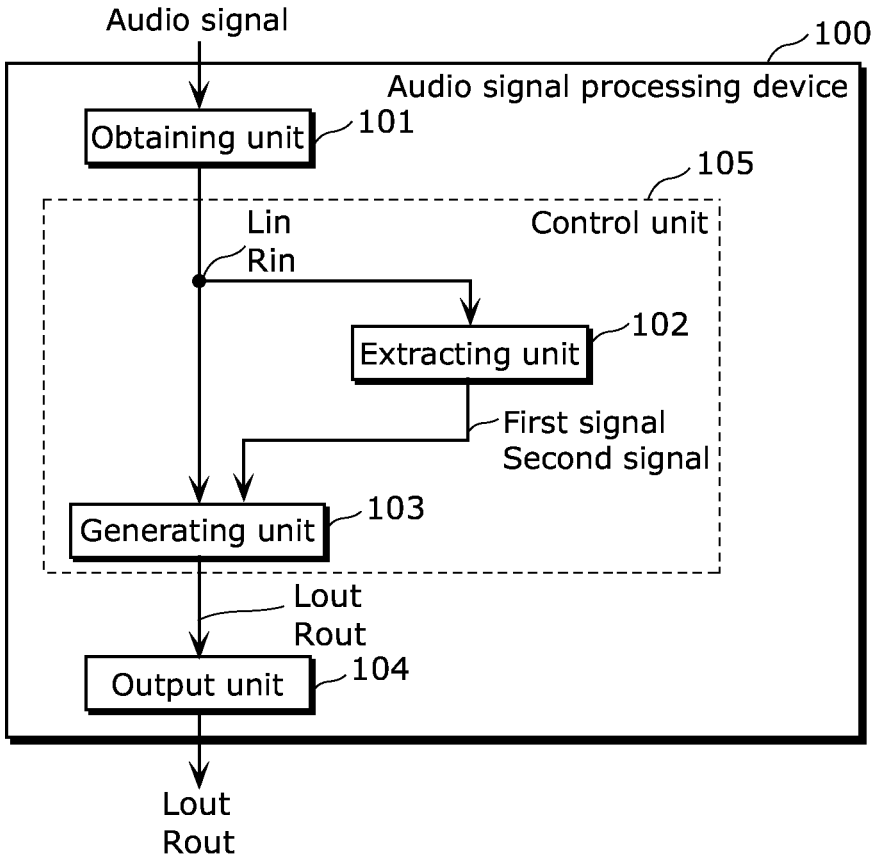
FIG. 3 is a functional block diagram illustrating a configuration of the audio signal processing device according to Embodiment 1.

FIG. 3 is a functional block diagram illustrating a configuration of the audio signal processing device 100. FIG. 4 is a flowchart of an operation of the audio signal processing device 100.

As FIG. 3 illustrates, the audio signal processing device 100 includes an obtaining unit 101, a control unit 105 (an extracting unit 102 and a generating unit 103), and an output unit 104.

Figure 4:
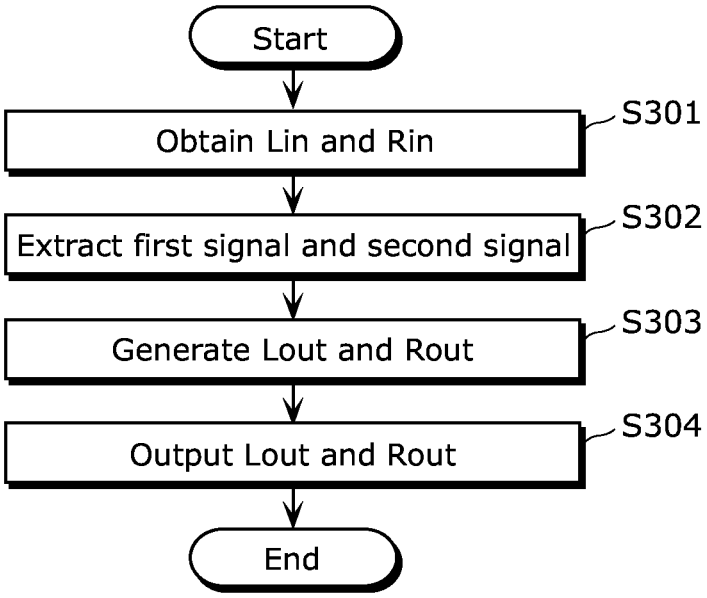
FIG. 4 is a flowchart of an operation of the audio signal processing device according to Embodiment 1.

The obtaining unit 101 obtains Lin and Rin (S301 in FIG. 4). Lin includes a sound localized closer to the left than to the right relative to the listener as a major component. Rin includes a sound localized closer to the right than to the left relative to the listener as a major component. The obtaining unit 101 is specifically an interface (input interface) provided to the audio signal processing device 100, for example, for receiving an audio signal.

The extracting unit 102 extracts a first signal and a second signal (S302 in FIG. 4). The first signal is a component of a sound included in the obtained Lin and localized closer to the right. The second signal is a component of a sound included in the obtained Rin and localized closer to the left. The method of extracting the first signal and the second signal performed by the extracting unit 102 will be described later in details.

Figure 5:
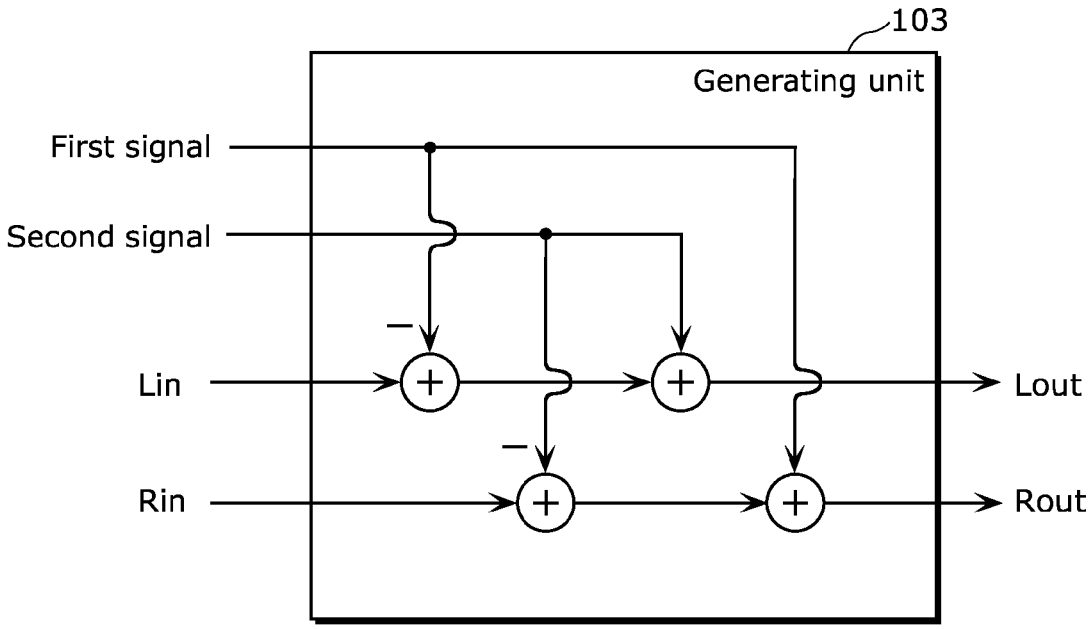
FIG. 5 schematically illustrates a specific configuration of a generating unit.

The generating unit 103 generates Lout by subtracting the first signal from Lin and adding the second signal to Lin, and generates Rout by subtracting the second signal from Rin and adding the first signal to Rin (S303 in FIG. 4). FIG. 5 schematically illustrates a specific configuration of the generating unit.

As FIG. 5 illustrates, specifically, the generating unit 103 generates Lout by subtracting the first signal from Lin and adding the second signal to the subtraction result, and generates Rout by subtracting the second signal from Rin and adding the first signal to the subtraction result.

The generating unit 103 may generate Lout by adding the second signal to Lin and subtracting the first signal from the addition result, and generate Rout by adding the first signal to Rin and subtracting the second signal from the addition result. In other words, any of the subtraction and addition may be performed first. The method of generating Lout and Rout will be described later in details.

The extracting unit 102 and the generating unit 103 are included in the control unit 105. The control unit 105 is specifically implemented by a processor such as a digital signal processor (DSP), a microcomputer, and a dedicated circuit.

The output unit 104 outputs the generated Lout and the generated Rout (S304 in FIG. 4). The output unit 104 is specifically an interface (output interface) provided to the audio signal processing device 100, for example, for outputting a signal.

As described in the above example of application, the destination of Lout and Rout output by the output unit 104 is not particularly limited. In Embodiment 1, the output unit 104 outputs Lout and Rout to speakers.

Next, each operation of the audio signal processing device 100 will be described in details.

[Operation of Obtaining Lin and Rin]

Hereinafter, an operation performed by the obtaining unit 101 to obtain Lin and Rin will be described in details.

As already described referring to FIG. 2, the obtaining unit 101 obtains Lin and Rin from a network such as the internet, for example. Moreover, for example, the obtaining unit 101 obtains Lin and Rin from a packaged media such as a hard disk, a Blu-ray disc, DVD, and CD, and a recording medium such as a flash memory.

Moreover, for example, the obtaining unit 101 obtains Lin and Rin from the radiowave of a television, a mobile phone, a wireless network and the like. Moreover, for example, the obtaining unit 101 obtains, as Lin and Rin, a signal of a sound collected by a sound collecting unit in a smart phone, an audio recorder, a digital still camera, a digital video camera, a personal computer, a microphone and the like.

In other words, the obtaining unit 101 may obtain Lin including a sound localized closer to the left than to the right as a major component and Rin including a sound localized closer to the right than to the left as a major component, via any route.

As described above, Lin and Rin are included in a stereo signal. In other words, Lin and Rin are an example of signals which represent a sound field between a first position and a second position. Lin is an example of a first audio signal. The sound localized closer to the left is an example of a sound localized closer to the first position than to the second position. Rin is an example of a second audio signal. The sound localized closer to the right is an example of a sound localized closer to the second position than to the first position. The first position and the second position are virtual positions between which the sound field represented by the stereo signal is present.

The obtaining unit 101 may obtain, as the first audio signal and the second audio signal, audio signals of two channels selected from among an audio signal of multi channels such as 5.1 channels. In this case, the obtaining unit 101 may obtain a front L signal as the first audio signal and a front R signal as the second audio signal. Alternatively, the obtaining unit 101 may obtain a surround L signal as the first audio signal and a surround R signal as the second audio signal. Moreover, the obtaining unit 101 may obtain the front L signal as the first audio signal and a center signal as the second audio signal. In other words, the obtaining unit 101 may obtain a pair of audio signals used to represent the same sound field.

[Operation of Extracting First Signal and Second Signal]

Figure 6:
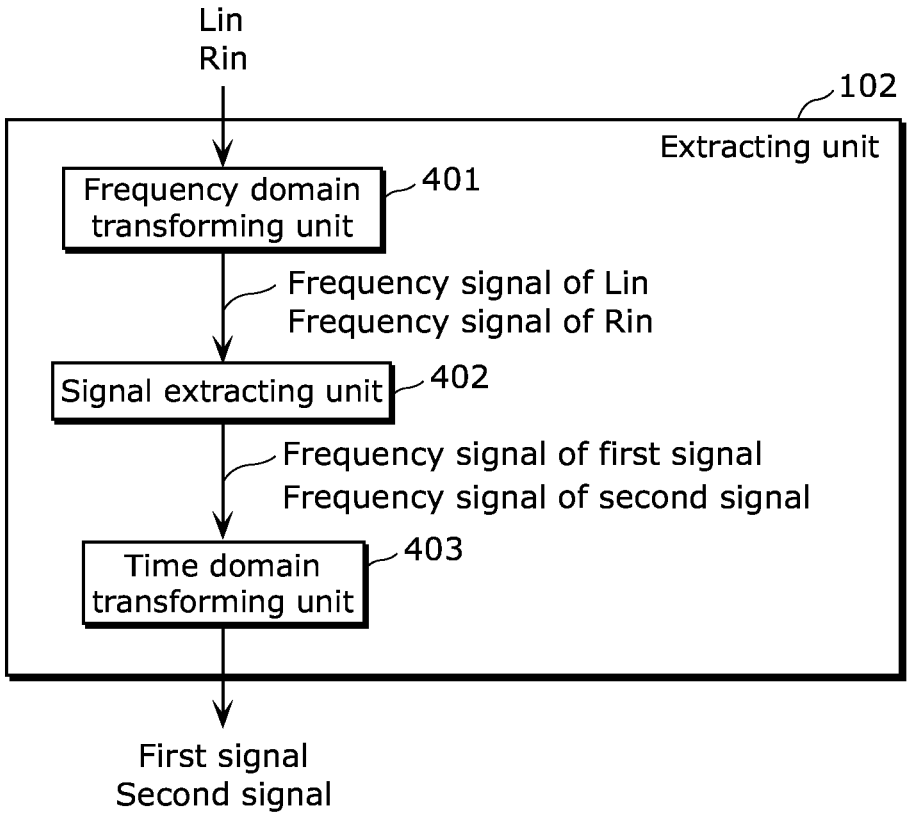
FIG. 6 is a functional block diagram illustrating a detailed configuration of an extracting unit.
Figure 7:
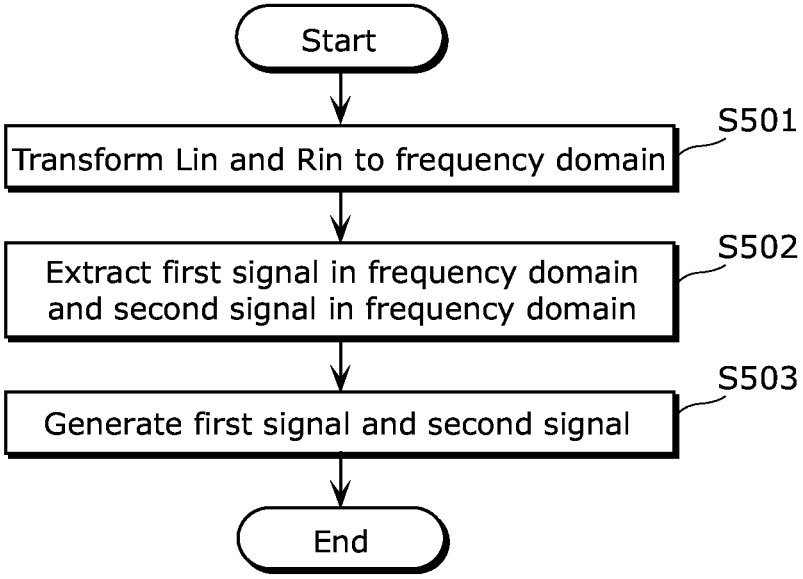
FIG. 7 is a flowchart of an operation of the extracting unit.

Hereinafter, an operation of extracting the first signal and the second signal performed by the extracting unit 102 will be described in details. FIG. 6 is a functional block diagram illustrating a detailed configuration of the extracting unit 102. FIG. 7 is a flowchart of an operation of the extracting unit 102.

As FIG. 6 illustrates, the extracting unit 102 includes a frequency domain transforming unit 401, a signal extracting unit 402, and a time domain transforming unit 403.

The frequency domain transforming unit 401 performs Fourier transform on Lin and Rin to transform a time-domain representation (hereinafter, simply referred to as time domain) to a frequency-domain representation (hereinafter, simply referred to as frequency domain) (S501 in FIG. 7). In Embodiment 1, the frequency domain transforming unit 401 transforms Lin and Rin from the time domain to the frequency domain by using fast Fourier transform. Lin in the frequency domain is an example of a first frequency signal. Rin in the frequency domain is an example of a second frequency signal. Specifically, the frequency domain transforming unit 401 generates the first frequency signal obtained by transforming Lin to the frequency domain, and the second frequency signal obtained by transforming Rin to the frequency domain.

The frequency domain transforming unit 401 may transform Lin and Rin to the frequency domain by using other general frequency transform such as discrete cosine transform and wavelet transform. In other words, the frequency domain transforming unit 401 may use any methods to transform a time domain signal to a frequency domain signal.

The signal extracting unit 402 compares the signal levels of Rin and Lin in the frequency domain, and determines the amount of extraction (extraction level, extraction coefficient) of Lin and Rin in the frequency domain based on the comparison result. The signal extracting unit 402 extracts, based on the determined amount of extraction, a first signal in the frequency domain from Lin in the frequency domain and a second signal in the frequency domain from Rin in the frequency domain (S502 in FIG. 7). In other words, the signal levels of the first frequency signal and the second frequency signal are compared for each of frequencies to determine the amount of extraction of the first signal and the second signal in the frequency domain for the frequency.

Here, the amount of extraction refers to a weight coefficient multiplied by Lin in the frequency domain when the first signal in the frequency domain is extracted (a weight coefficient multiplied by Rin when the second signal in the frequency domain is extracted).

For example, when the amount of extraction of the first signal in the frequency domain in a given frequency is 0.5, the signal level of the frequency component in the first signal in the frequency domain is equal to a signal level obtained by multiplying the frequency component of Lin in the frequency domain by 0.5.

The signal extracting unit 402 determines, for example, the amount of extraction of the first signal in the frequency domain to be greater for a frequency in which the signal level of Lin in the frequency domain is less than that of Rin in the frequency domain and where the difference between the signal levels is greater. In a similar manner, the signal extracting unit 402 determines, for example, the amount of extraction of the second signal in the frequency domain to be greater for a frequency in which the signal level of Rin in the frequency domain is less than that of Lin in the frequency domain and where the difference between the signal levels is greater.

For example, in the frequency of f hertz (where f is a real number), a is the signal level of Lin in the frequency domain, b is the signal level of Rin in the frequency domain, and k is a predetermined threshold (where k is a positive real number). In this case, the signal extracting unit 402 determines the amount of extraction of components of frequency f of the first signal in the frequency domain to be b/a when $b/a \geq k$ is satisfied and 0 when $b/a < k$ is satisfied. In a similar manner, the signal extracting unit 402 determines the amount of extraction of components of frequency f of the second signal in the frequency domain to be a/b when $a/b \geq k$ is satisfied and 0 when $a/b < k$ is satisfied. Typically, k is set to 1.

The method of determining the amount of extraction is not limited to the above examples. The amount of extraction may be determined according to the music genre and the like of a sound source as described later, or the amount of extraction calculated by the above determining method can be further adjusted according to the music genre of the sound source.

The above described extracting methods are examples, and may be other than the examples. For example, the signal extracting unit 402 subtracts, in the frequency domain, a differential signal $\alpha Lin - \beta Rin$ (where $\alpha$ and $\beta$ are real numbers) from Lin+Rin that is a summed signal of Lin and Rin to extract a frequency signal of the first signal and a frequency signal of the second signal. Note that $\alpha$ and $\beta$ are appropriately set according to the range of signals to be extracted and the amount of extraction of the signals. Details of such an extracting method are described in PTL 2, and thus, detailed descriptions thereof are omitted.

The time domain transforming unit 403 performs inverse Fourier transform on the first signal in the frequency domain extracted from Lin to transform from the frequency domain to the time domain. In this way, the time domain transforming unit 403 generates the first signal. Moreover, the time domain transforming unit 403 performs inverse Fourier transform on the second signal in the frequency domain extracted from Rin to transform from the frequency domain to the time domain. In this way, the time domain transforming unit 403 generates the second signal (S503 in FIG. 7). In Embodiment 1, the time domain transforming unit 403 uses Fast inverse Fourier transform for inverse transform.

[Specific Example 1 of Operation of Audio Signal Processing Device]

Figure 8:
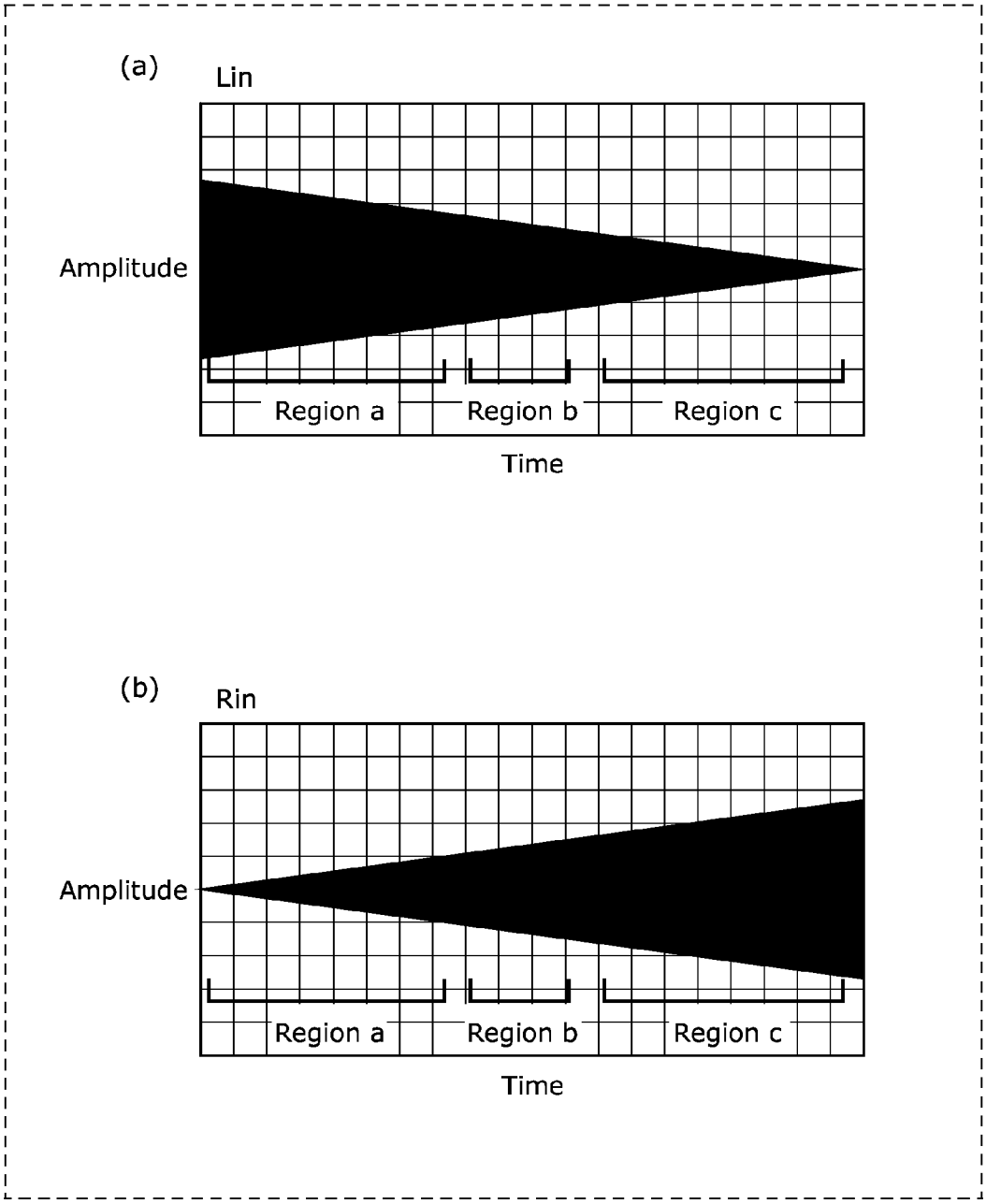
FIG. 8 is a first diagram illustrating a specific example of Lin and Rin.

Hereinafter, referring to FIG. 8 to FIG. 11, a specific example of an operation of the audio signal processing device 100 will be described. FIG. 8 illustrates a specific example of Lin and Rin. In FIG. 8, the horizontal axes represent time and the vertical axes represent amplitude.

Lin illustrated in (a) of FIG. 8 and Rin illustrated in (b) of FIG. 8 are both sine waves of 3 kHz. Here, Lin and Rin are in phase. As illustrated in (a) of FIG. 8, loudness of Lin decreases over time, and as illustrated in (b) of FIG. 8, loudness of Rin increases over time. With such a configuration, the horizontal axes in FIG. 8 may be regarded as the localization position (region) of a sound.

In the following descriptions (including specific examples 2 and 3), it is assumed that the listener listens to the sound at the intermediate position of and in front of the speakers which reproduce Lin and Rin. Specifically, the position of the speaker which reproduces Lin is to the left of the listener (L direction), the position of the speaker which reproduces Rin is to the right of the listener (R direction), and the front of the listener is the center (center direction).

In FIG. 8, in region a (time period corresponding to region a), the signal level of Lin is greater than that of Rin, and the sine waves of 3 kHz are localized to the left of the listener. In region b (time period corresponding to region b), the signal level of Lin is approximately equal to that of Rin, and the sine waves of 3 kHz are localized to the approximately front of the listener. In region c (time period corresponding to region c), the signal level of Lin is less than that of Rin, and the sine waves of 3 kHz are localized to the right of the listener.

Figure 9:
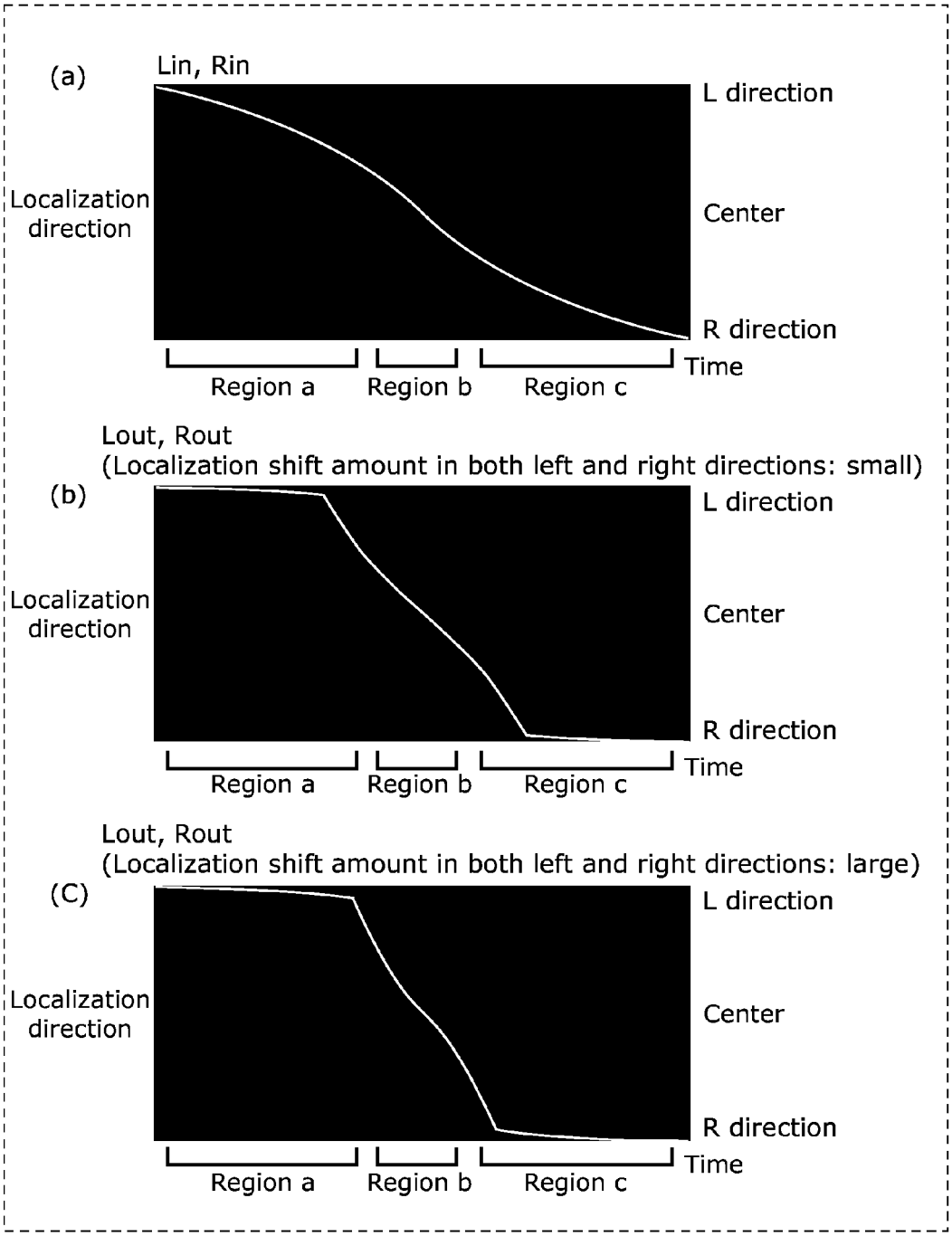
FIG. 9 illustrates the localization positions of a sound localized by a reproduced sound of Lin in FIG. 8 and a reproduced sound of Rin in FIG. 8.

FIG. 9 illustrates the localization positions of the sound localized by the reproduced sounds of the above Lin and Rin. In FIG. 9, the direction of localization is obtained by a panning method (a method of analyzing the localization direction based on ratio of sound pressure of Lin and Rin). In FIG. 9, the white portions indicate a high signal level. In FIG. 9, the horizontal axes represent time and the vertical axes represent localization direction. The time scale of the horizontal axes in FIG. 9 is the same as that in FIG. 8. Regions a, b, and c in FIG. 9 respectively correspond to regions a, b, and c in FIG. 8.

As (a) of FIG. 9 illustrates, the localization position of the sound localized by the reproduced sounds of Lin and Rin is gradually shifted from the left to the center, and then to the right over time.

In FIG. 9, (b) and (c) each illustrate the localization position of the sound localized by the reproduced sounds of Lout and Rout generated by the audio signal processing device 100. The representation method (manner) in (b) and (c) of FIG. 9 is the same as that in (a) of FIG. 9. In FIG. 9, (b) illustrates the case where the shift amount of sound localization is small, whereas (c) illustrates the case where the shift amount of sound localization is large.

It is understood from the comparison between (a) and (b) in FIG. 9 that the localization position of the sound localized by the reproduced sounds of Lout and Rout is concentrated in and around region a and region c. In other words, the localization position of the sound is changed by the audio signal processing device 100. The reproduced sounds of Lout and Rout extend the localization distribution of the sound in and around region b in the left and right directions (vertical direction in (b) of FIG. 9) with respect to the center, while the localization of the sound in region b is maintained.

Moreover, it is understood from the comparison between (b) and (c) in FIG. 9 that the localization position of the sound localized by the reproduced sounds of Lout and Rout is further concentrated in and around region a and region c in (c) of FIG. 9. In (c) of FIG. 9, the reproduced sounds of Lout and Rout further extend the localization distribution of the sound in and around region b in the left and right directions with respect to the center.

Figure 10:
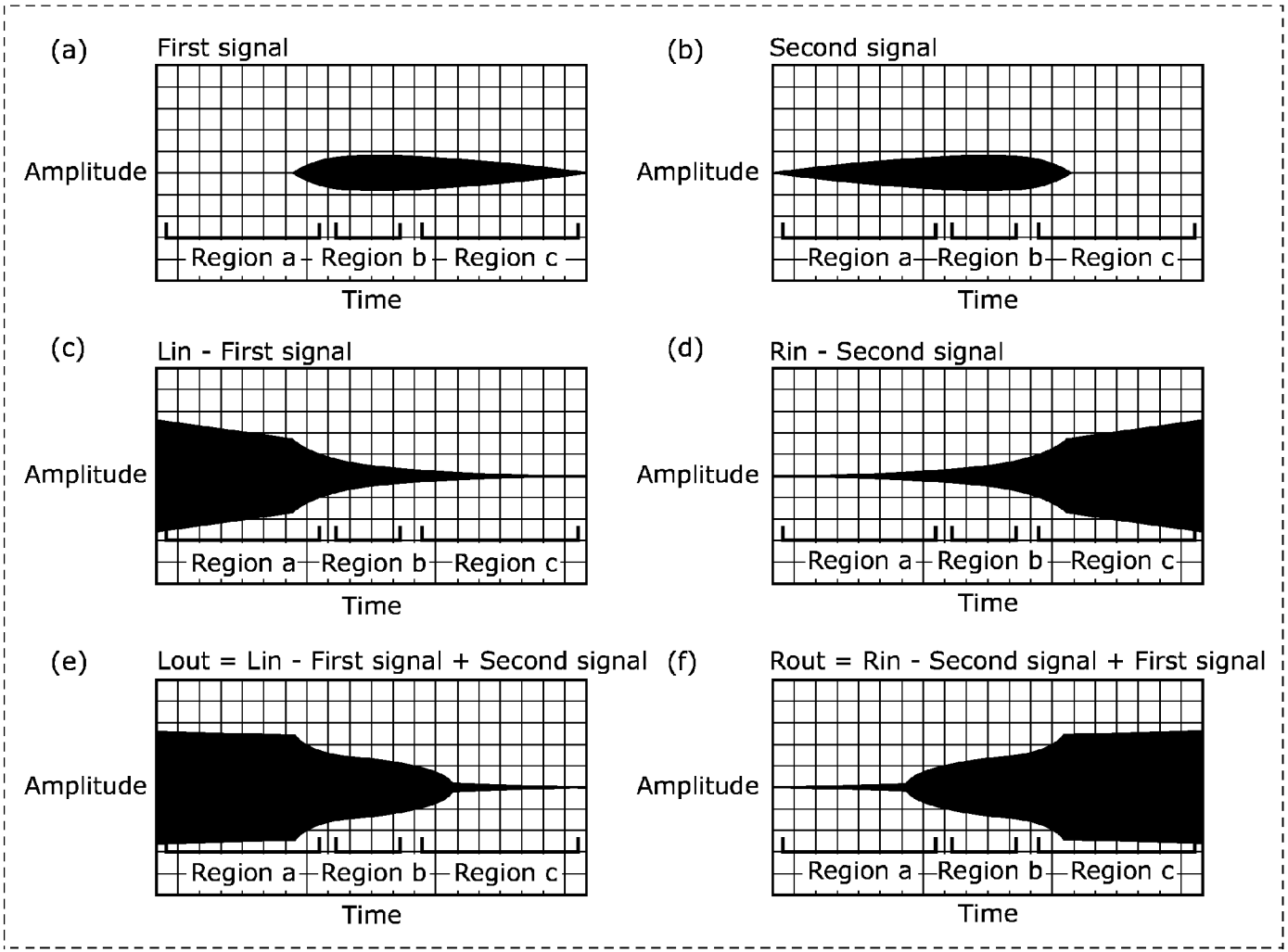
FIG. 10 is a first diagram illustrating a method of generating Lout and Rout.

Here, a method for generating Lout and Rout providing the localization of the sound illustrated in (b) of FIG. 9 will be described referring to FIG. 10. FIG. 10 illustrates the method for generating Lout and Rout. In FIG. 10, the horizontal axes represent time and the vertical axes represent amplitude. The time scale of the horizontal axes and the amplitude scale of the vertical axes in FIG. 10 are the same as those in FIG. 8. Regions a, b, and c in FIG. 10 respectively correspond to regions a, b, and c in FIG. 8.

In FIG. 10, (a) illustrates a first signal. The first signal is a signal obtained by extracting a component of a sound included in Lin ((a) of FIG. 8) and localized closer to region c (closer to the right). In FIG. 10, (b) illustrates a second signal. As described above, the second signal is a signal obtained by extracting a component of a sound included in Rin ((b) of FIG. 8) and localized closer to region a (closer to the left).

In FIG. 10, (c) illustrates a signal obtained by subtracting the first signal from Lin. As can be understood from (c) of FIG. 10, relative to the signal obtained by subtracting the first signal from Lin, the signal level in region c (right side) is less than that of Lin. In a similar manner, in FIG. 10, (d) illustrates a signal obtained by subtracting the second signal from Rin. As can be understood from (d) of FIG. 10, relative to the signal obtained by subtracting the second signal from Rin, the signal level in region a (left side) is less than that of Rin.

In FIG. 10, (e) illustrates Lout that is a signal obtained by subtracting the first signal from Lin and adding the second signal to Lin, and (f) illustrates Rout that is a signal obtained by subtracting the second signal from Rin and adding the first signal to Rin.

The signal level of Lout in region a (left side) is greater than that of Lin. The signal level of Rout in region a is less than that of Rin. In other words, with Lout and Rout, the localization position of the sound can be shifted (moved) toward the left side.

The signal level of Lout in region c (right side) is less than that of Lin. The signal level of Rout in region c is greater than that of Rin. In other words, with Lout and Rout, the localization position of the sound can be shifted (moved) toward the right side.

In order to change the localization position, the addition (addition of the second signal to Lin and addition of the first signal to Rin) is not necessarily needed. However, the addition satisfies the relation of Lin+Rin=Lout+Rout, and thereby maintaining the signal level as a whole and minimizing a change in quality and volume perception after signal processing.

Figure 11:
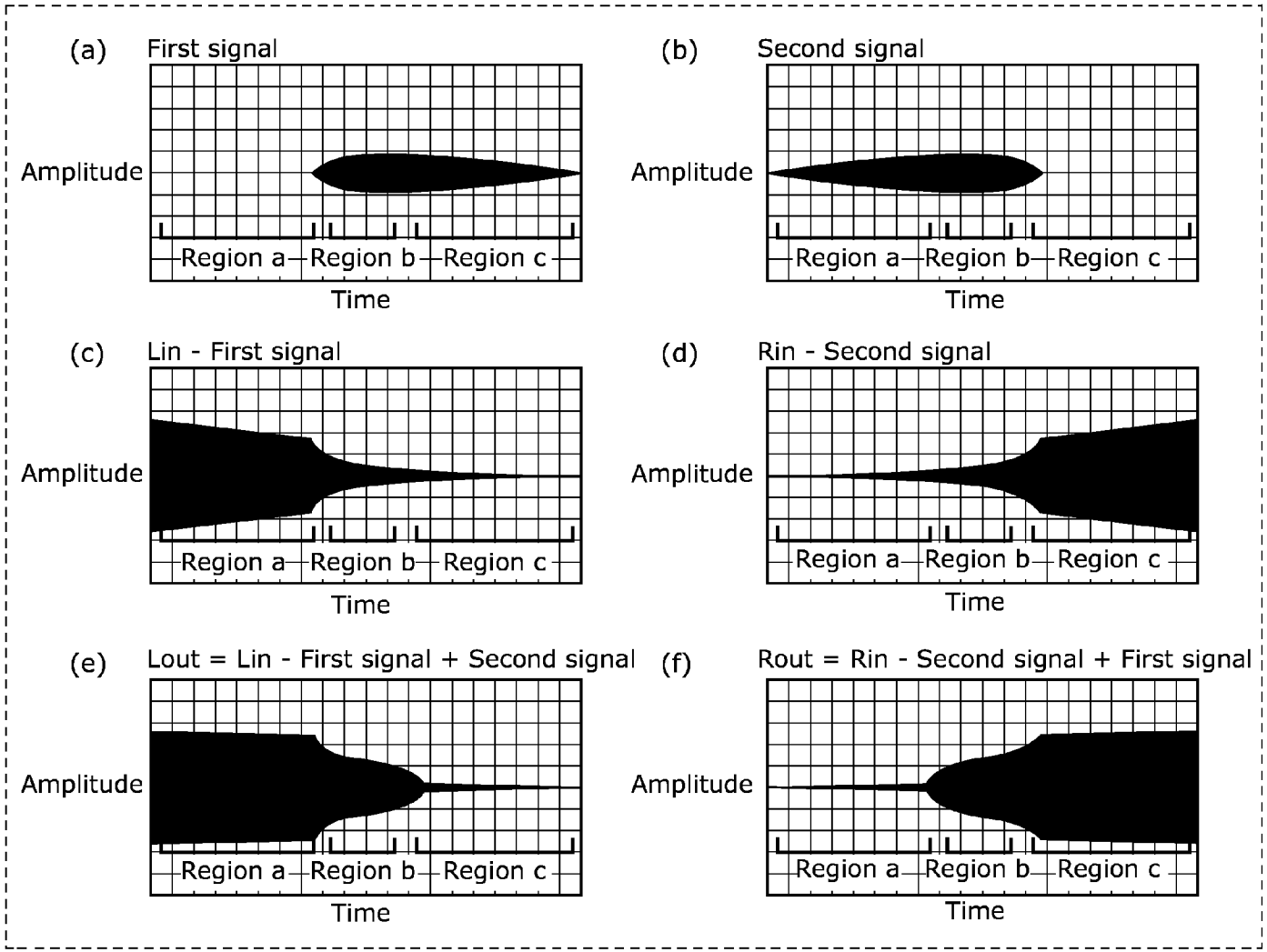
FIG. 11 is a second diagram illustrating the method of generating Lout and Rout.

As (c) of FIG. 9 illustrates, the localization position of the sound can be further moved in the left and right directions by changing the amount of extraction of the first signal and the second signal. A method for generating Lout and Rout providing the sound localization illustrated in (c) of FIG. 9 will be described referring to FIG. 11. FIG. 11 illustrates the method for generating Lout and Rout. In FIG. 11, the horizontal axes represent time and the vertical axes represent amplitude. The time scale of the horizontal axes and the amplitude scale of the vertical axes in FIG. 11 are the same as those in FIG. 8. Regions a, b, and c in FIG. 11 respectively correspond to regions a, b, and c in FIG. 8.

In FIG. 11, (a) illustrates a first signal, and (b) illustrates a second signal. In FIG. 11, (c) illustrates a signal obtained by subtracting the first signal from Lin, and (d) illustrates a signal obtained by subtracting the second signal from Rin. It is understood from FIG. 11 that the amount of extraction of the first signal and the second signal is greater than that in FIG. 10.

The signal level of Lout in region a illustrated in (e) in FIG. 11 is greater than that of Lout illustrated in (e) of FIG. 10. In other words, Lout illustrated in (e) of FIG. 11 can further shift (move) the localization position of the sound in the left direction compared to Lout illustrated in (e) of FIG. 10. In a similar manner, the signal level of Rout in region c illustrated in (f) of FIG. 11 is greater than that of Rout illustrated in (f) of FIG. 10. In other words, Rout illustrated in (f) of FIG. 11 can further shift (move) the localization position of the sound in the right direction compared to Rout illustrated in (f) of FIG. 10. Here, the relation of Lin+Rin=Lout+Rout is also satisfied, and the signal level as a whole (the signal level of the summed signal of Lin and Rin) remains the same.

As described above, according to the audio signal processing method performed by the audio signal processing device 100, while localizing a sound in and around the center, the localization positions of other sounds can be shifted in the left and right directions, and the shift amount of sound localization in the left and right directions can be changed. In this way, the listener can listen to the sound in and around the center clearly.

In the examples of FIG. 8 to FIG. 11, it is assumed that the listener listens to a sound at the intermediate position of and in front of speakers which reproduce Lin and Rin. However, the position of the listener may be other than the above. The listener can clearly listen to the sound in and around the center even when the listener is positioned closer to the speaker which reproduces Lout or when the listener is positioned closer to the speaker which reproduces Rout.

[Specific Example 2 of Operation of Audio Signal Processing Device]

Figure 12:
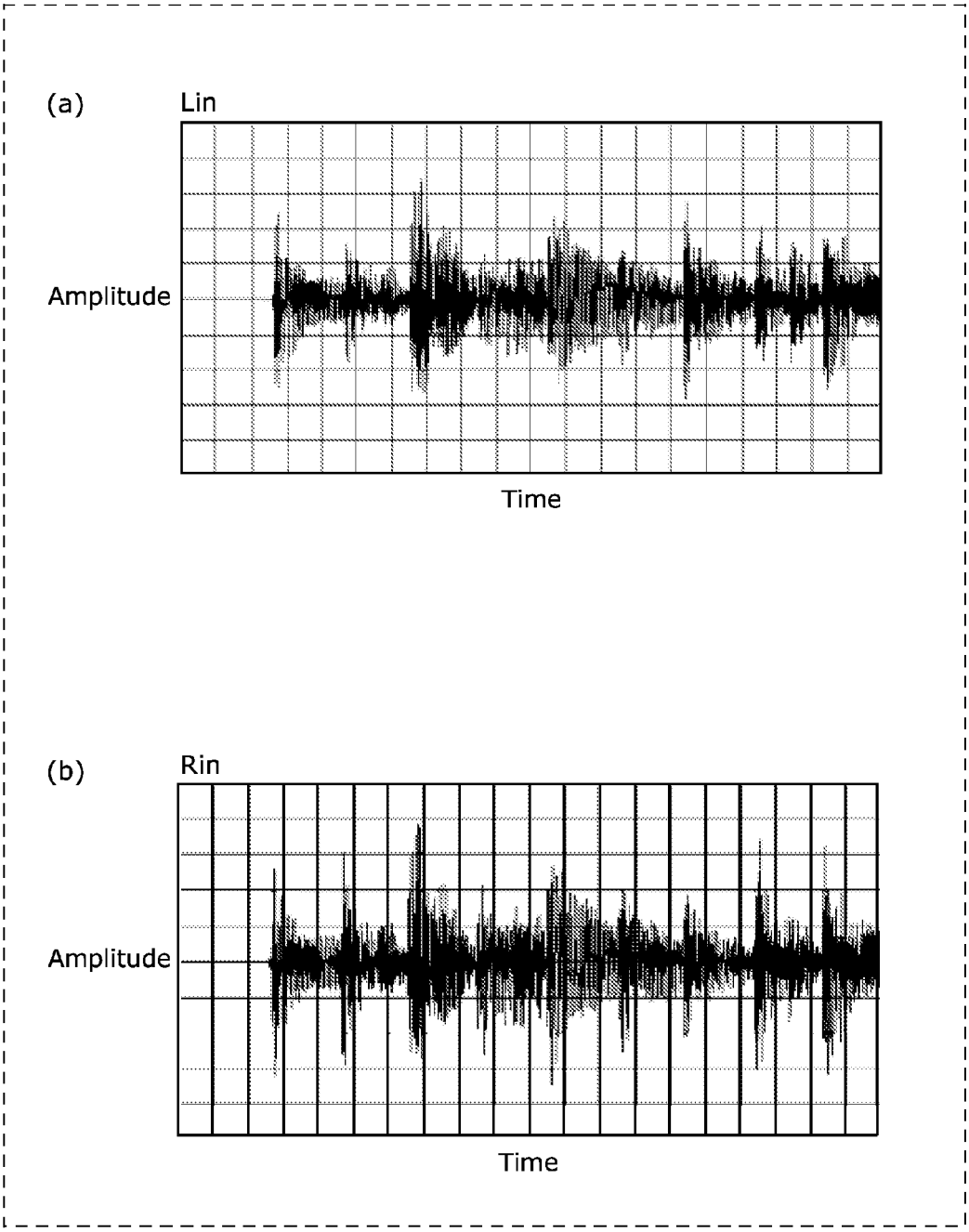
FIG. 12 is a second diagram illustrating a specific example of Lin and Rin.

Hereinafter, another specific example of an operation of the audio signal processing device 100 will be described. Referring to FIG. 12 to FIG. 15, an example where Lin and Rin are used which are included in a stereo sound source of pop music will be described. FIG. 12 illustrates a specific example of Lin and Rin. In FIG. 12, the horizontal axes represent time and the vertical axes represent amplitude.

Figure 13:
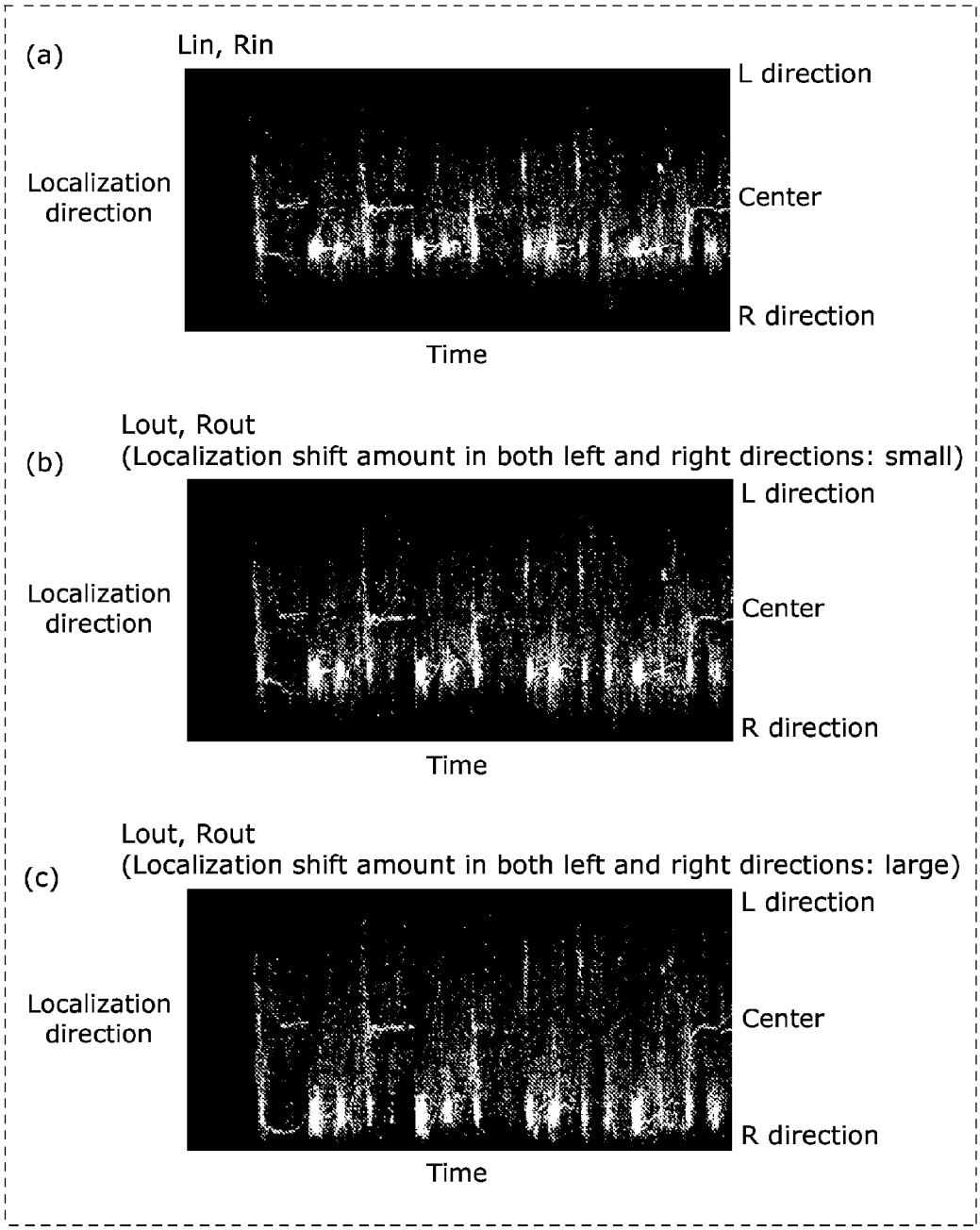
FIG. 13 illustrates the localization position of a sound localized by a reproduced sound of Lin in FIG. 12 and a reproduced sound of Rin in FIG. 12.

FIG. 13 illustrates the localization position of the sound localized by the reproduced sounds of the above Lin and Rin. In FIG. 13, the localization position is obtained by a panning method. The white portions indicate a high signal level. In FIG. 13, the horizontal axes represent time and the vertical axes represent localization direction. The time scale of the horizontal axes in FIG. 13 is the same as that in FIG. 12.

As (a) of FIG. 13 illustrates, the localization position of a sound localized by the reproduced sounds of Lin and Rin is concentrated in and around the center.

Each of (b) and (c) in FIG. 13 illustrates the localization position of a sound localized by the reproduced sounds of Lout and Rout generated by the audio signal processing device 100. The representation method (manner) in (b) and (c) of FIG. 13 is the same as that in (a) of FIG. 13. In FIG. 13, (b) illustrates the case where the shift amount of sound localization is small, whereas (c) illustrates the case where the shift amount of sound localization is large.

It is understood from the comparison between (a) and (b) of FIG. 13 that the localization position of the sound in (b) of FIG. 13 is slightly extended in the left and right directions.

It is understood from the comparison between (b) and (c) of FIG. 13 that the localization position of the sound in (c) of FIG. 13 is further extended in the left and right directions.

Figure 14:
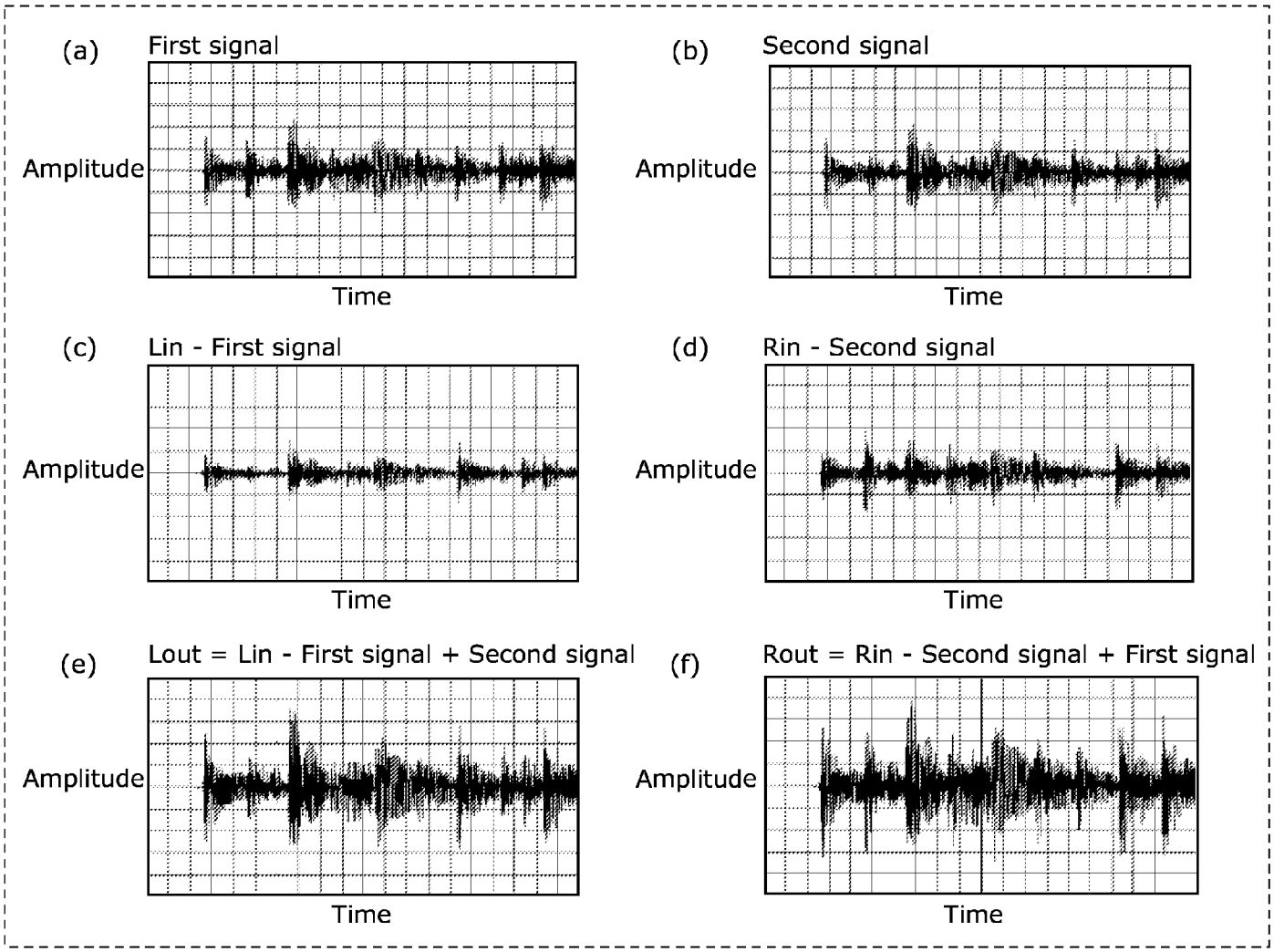
FIG. 14 is a first diagram illustrating the signal waveforms obtained when Lout and Rout are generated.

Here, the signal waveforms obtained when generating Lout and Rout providing the localization of the sound illustrated in (b) of FIG. 13 are illustrated in FIG. 14. FIG. 14 illustrates the signal waveforms obtained when Lout and Rout are generated. In FIG. 14, the horizontal axes represent time and the vertical axes represent amplitude. The time scale of the horizontal axes and the amplitude scale of the vertical axes in FIG. 14 are the same as those in FIG. 12.

In FIG. 14, (a) illustrates a first signal, and (b) illustrates a second signal. In FIG. 14, (c) illustrates an Lin—first signal, and (d) illustrates an Rin—second signal. In FIG. 14, (e) illustrates Lout, and (f) illustrates Rout.

Figure 15:
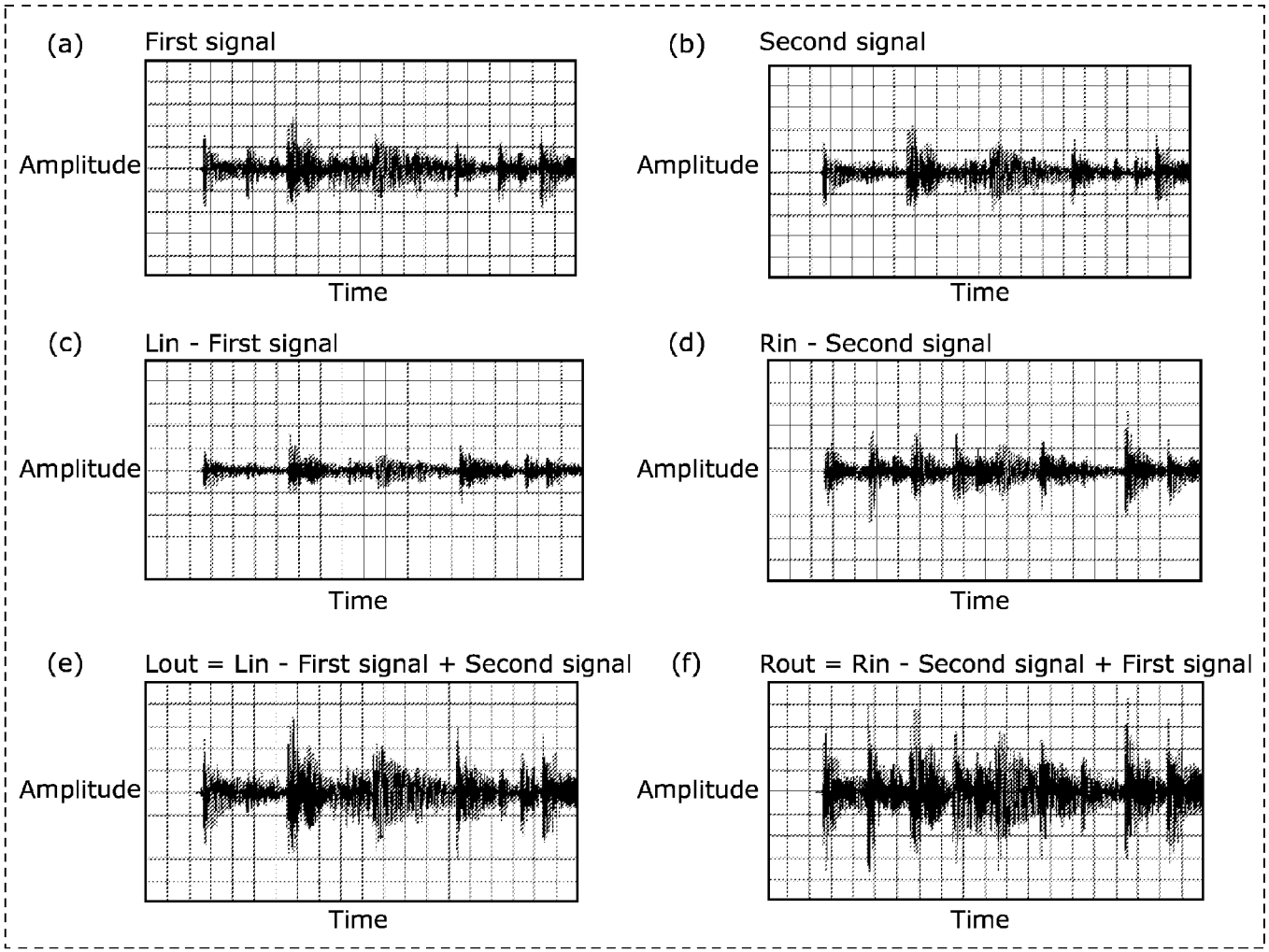
FIG. 15 is a second diagram illustrating the signal waveforms obtained when Lout and Rout are generated.

FIG. 15 illustrates the signal waveforms obtained when generating Lout and Rout providing the localization of the sound illustrated in (c) of FIG. 13. FIG. 15 illustrates the signal waveforms obtained when Lout and Rout are generated. In FIG. 15, the horizontal axes represent time and the vertical axes represent amplitude. The time scale of the horizontal axes and the amplitude scale of the vertical axes in FIG. 15 are the same as those in FIG. 12.

In FIG. 15, (a) illustrates a first signal, and (b) illustrates a second signal. In FIG. 15, (c) illustrates an Lin—first signal, and (d) illustrates an Rin—second signal. In FIG. 15, (e) illustrates Lout, and (f) illustrates Rout.

In both FIG. 14 and FIG. 15, the relation of Lin+Rin=Lout+Rout is satisfied, and the signal level as a whole is not changed.

As described above, according to the audio signal processing method performed by the audio signal processing device 100, while localizing a sound in and around the center, the localization positions of the other sounds can be shifted in the left and right directions. Additionally, the shift amount of sound localization in the left and right directions can also be changed. In this way, the listener can listen to the sound in and around the center clearly.

For example, as FIG. 12 and (a) of FIG. 13 illustrate, there may be a case where the localization position of the sound localized by the reproduced sounds of Lin and Rin is concentrated in the center. In such a case, a sound field which greatly expands in the left and right directions can be generated by Lout and Rout generated such that the shift amount of sound localization is large.

[Specific Example 3 of Operation of Audio Signal Processing Device]

Hereinafter, another specific example of an operation of the audio signal processing device 100 will be described. Referring to FIG. 16 to FIG. 19, an example where Lin and Rin are used which are included in a stereo sound source of classic music will be described.

Figure 16:
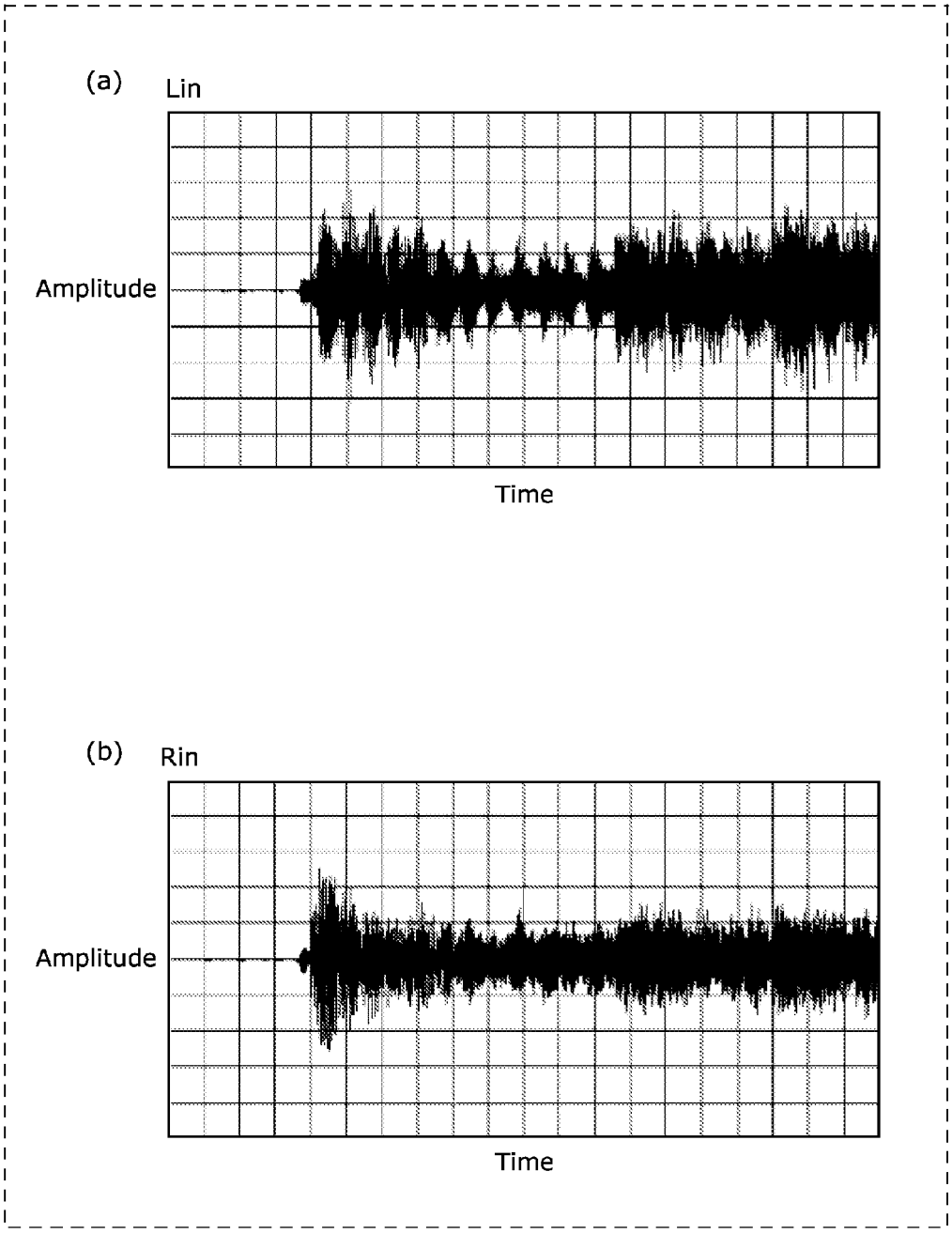
FIG. 16 is a third diagram illustrating a specific example of Lin and Rin.

FIG. 16 illustrates a specific example of Lin and Rin. In FIG. 16, the horizontal axes represent time and the vertical axes represent amplitude.

Figure 17:
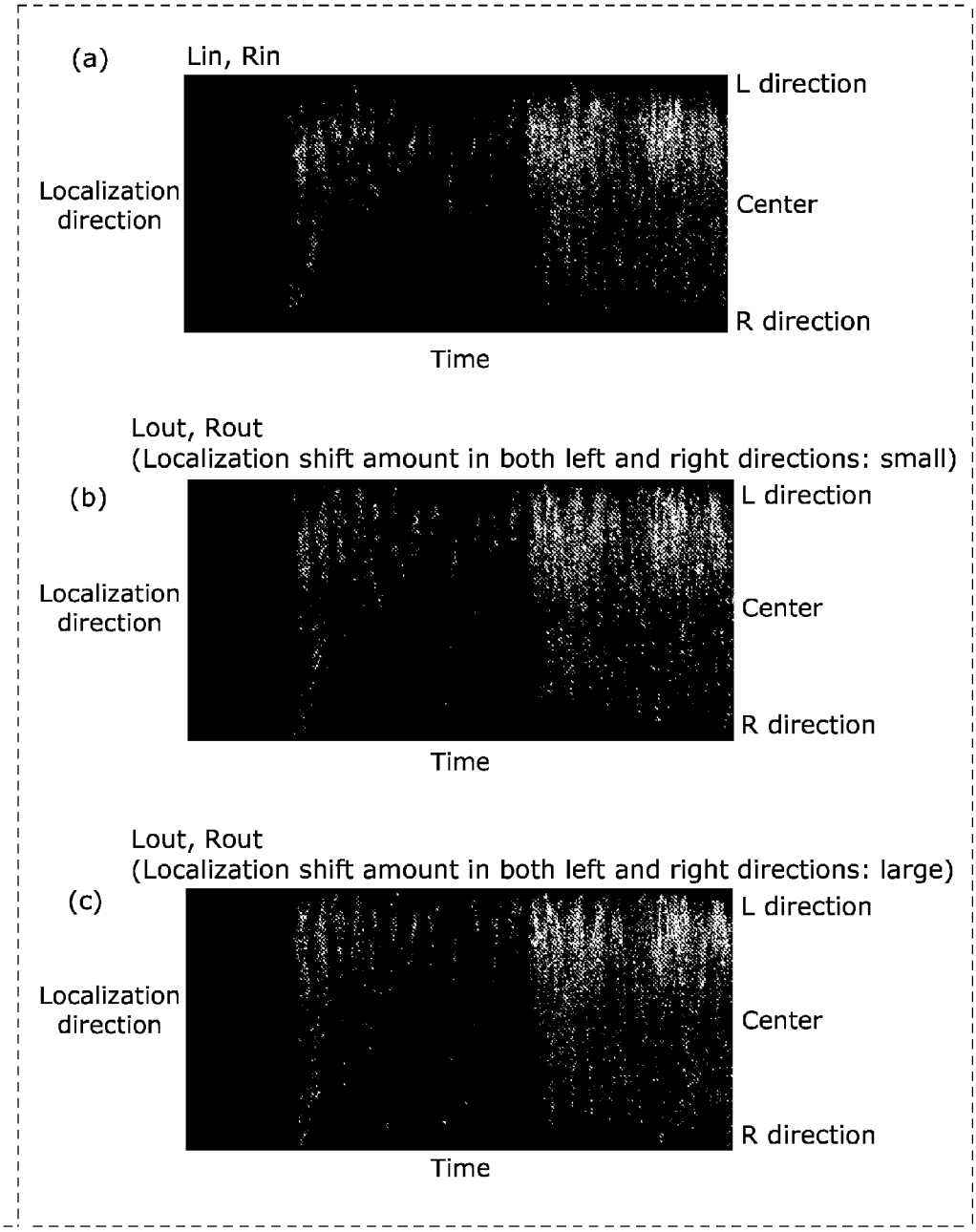
FIG. 17 illustrates the localization position of a sound localized by a reproduced sound of Lin in FIG. 16 and a reproduced sound of Rin in FIG. 16.

FIG. 17 illustrates the localization position of a sound localized by the reproduced sounds of the above Lin and Rin. In FIG. 17, the localization position is obtained by a panning method. The white portions indicate a high signal level. In FIG. 17, the horizontal axes represent time and the vertical axes represent localization direction. The time scale of the horizontal axes in FIG. 17 is the same as that in FIG. 16.

As (a) of FIG. 17 illustrates, the localization position of the sound localized by the reproduced sounds of Lin and Rin is spread in the left and right directions.

Each of (b) and (c) in FIG. 17 illustrates the localization position of a sound localized by the reproduced sounds of Lout and Rout generated by the audio signal processing device 100. The representation method (manner) in (b) and (c) of FIG. 17 is the same as that in (a) of FIG. 17. In FIG. 17, (b) illustrates the case where the shift amount of sound localization is small, whereas (c) illustrates the case where the shift amount of sound localization is large.

It is understood from the comparison between (a) and (b) of FIG. 17 that the localization position of the sound in (b) of FIG. 17 is slightly extended in the left and right directions.

It is understood from the comparison between (b) and (c) of FIG. 17 that the localization position of the sound in (c) of FIG. 17 is further extended in the left and right directions.

Figure 18:
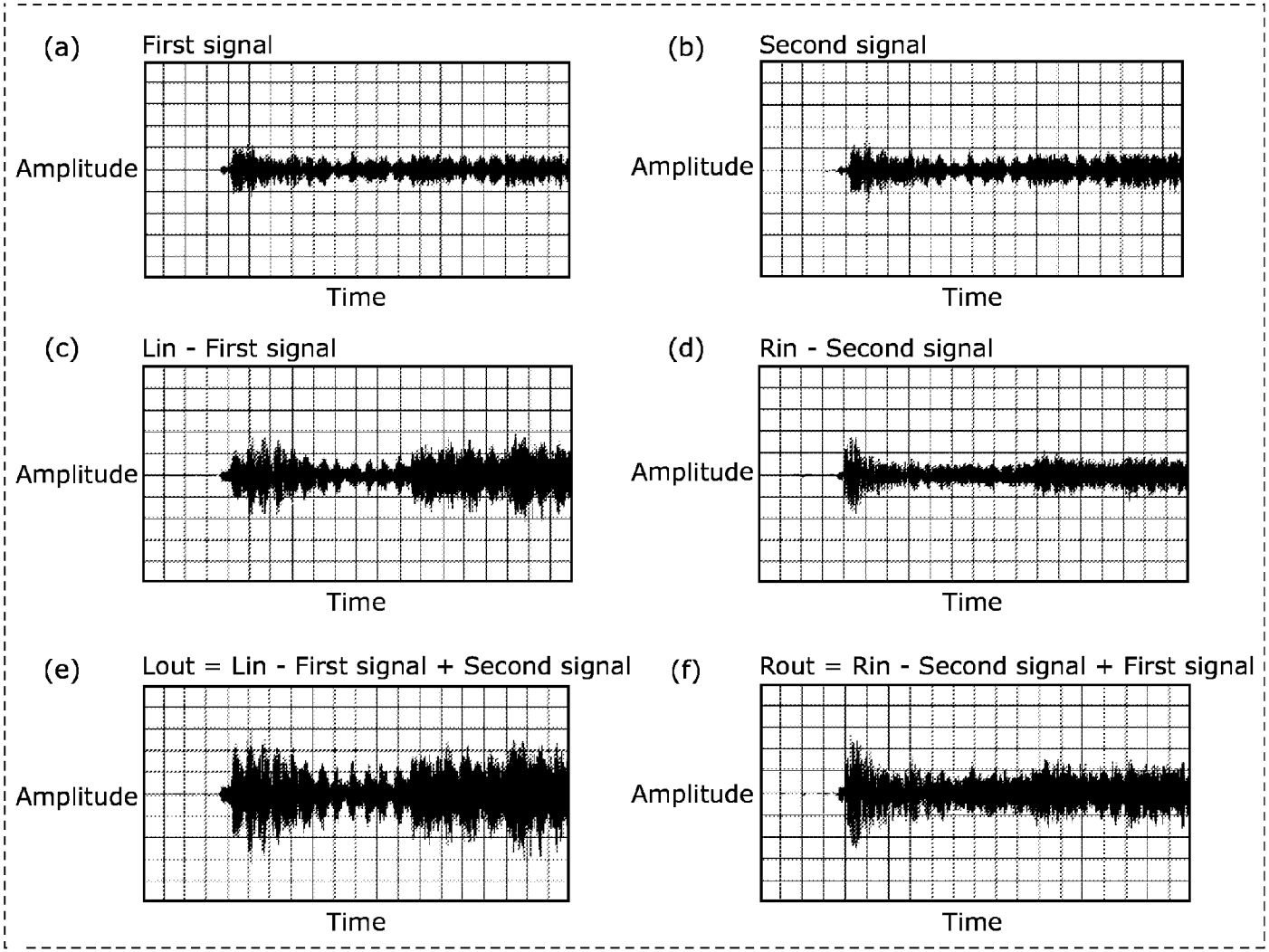
FIG. 18 is a third diagram illustrating the signal waveforms obtained when Lout and Rout are generated.

Here, the signal waveforms obtained when generating Lout and Rout providing the localization of the sound illustrated in (b) of FIG. 17 are illustrated in FIG. 18. FIG. 18 illustrates the signal waveforms obtained when Lout and Rout are generated. In FIG. 18, the horizontal axes represent time and the vertical axes represent amplitude. The time scale of the horizontal axes and the amplitude scale of the vertical axes in FIG. 18 are the same as those in FIG. 16.

In FIG. 18, (a) illustrates a first signal, and (b) illustrates a second signal. In FIG. 18, (c) illustrates an Lin—first signal, and (d) illustrates an Rin—second signal. In FIG. 18, (e) illustrates Lout, and (f) illustrates Rout.

Figure 19:
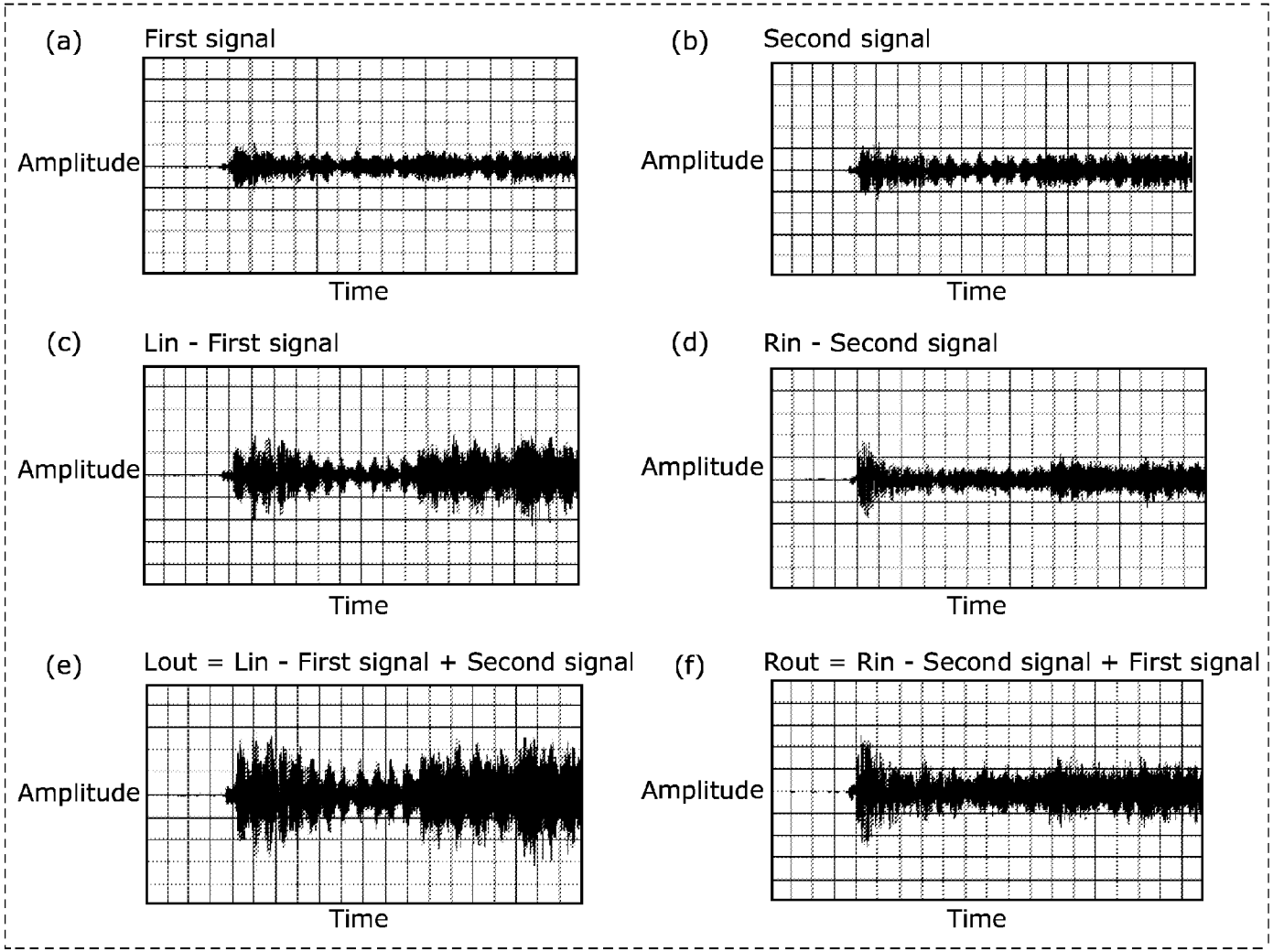
FIG. 19 is a fourth diagram illustrating the signal waveforms obtained when Lout and Rout are generated.

The signal waveforms obtained when generating Lout and Rout providing the localization of the sound illustrated in (c) of FIG. 17 are illustrated in FIG. 19. FIG. 19 illustrates the signal waveforms obtained when Lout and Rout are generated. In FIG. 19, the horizontal axes represent time and the vertical axes represent amplitude. The time scale of the horizontal axes and the amplitude scale of the vertical axes in FIG. 19 are the same as those in FIG. 16.

In FIG. 19, (a) illustrates a first signal, and (b) illustrates a second signal. In FIG. 19, (c) illustrates an Lin—first signal, and (d) illustrates an Rin—second signal. In FIG. 19, (e) illustrates Lout, and (f) illustrates Rout.

In both FIG. 18 and FIG. 19, the relation of Lin+Rin=Lout+Rout is satisfied, and the signal level as a whole is not changed.

As described above, according to the audio signal processing method performed by the audio signal processing device 100, while localizing a sound in and around the center, the localization positions of the other sounds can be shifted in the left and right directions. Additionally, the shift amount of sound localization in the left and right directions can be changed. In this way, the listener can listen to the sound in and around the center clearly.

For example, as FIG. 16 and (a) of FIG. 17 illustrate, there may be a case where the localization position of the sound included in Lin and Rin is spread in the left and right directions. In such a case, it is possible to minimize excessive spread of the sound localization position in the left and right directions, by Lout and Rout generated such that the shift amount of sound localization is small.

CONCLUSION

As described above, according to the audio signal processing method performed by the audio signal processing device 100, while localizing a sound in and around the center, the localization positions of the other sounds can be shifted in the left and right directions. Additionally, the shift amount of sound localization in the left and right directions can be changed. In other words, the audio signal processing device 100 can change the localization position of the sound localized between the reproduced positions of two audio signals, by performing signal processing.

Figure 20:
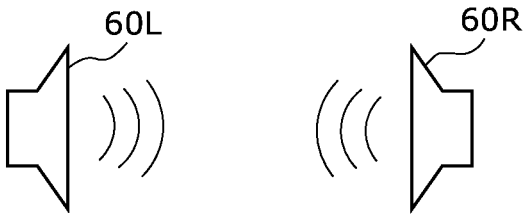
FIG. 20 is a first diagram for illustrating an example of a speaker layout.
Figure 21:
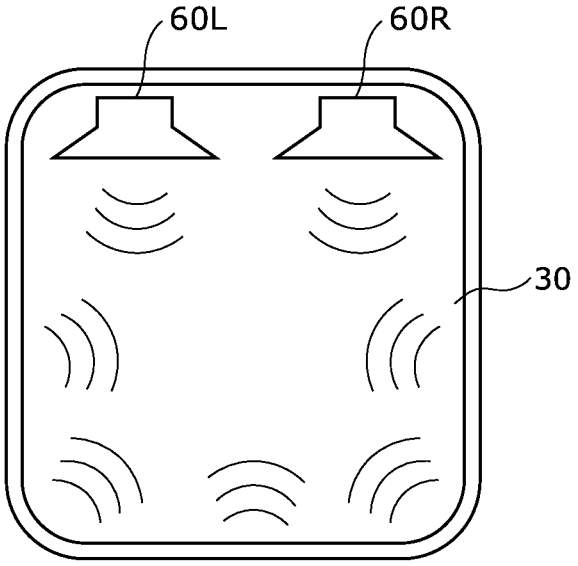
FIG. 21 is a second diagram for illustrating an example of a speaker layout.

The layout of speakers which reproduce Lout and Rout may be any layout as long as the L-channel speaker is positioned to the left of the R-channel speaker viewed from the listener. However, the audio signal processing method performed by the audio signal processing device 100 is particularly effective in the speaker layout in which a sound is likely to be concentrated in and around the center. Such a layout will be described referring to FIG. 20 and FIG. 21. FIG. 20 and FIG. 21 illustrate examples of speaker layout.

In FIG. 20, an L-channel speaker 60L and an R-channel speaker 60R for reproducing a stereo signal are arranged such that the front of the L-channel speaker 60L faces the front of the R-channel speaker 60R. In the case where the speaker layout has limitations (for example, on-vehicle audio), such a layout is used.

When the L-channel speaker 60L and the R-channel speaker 60R are disposed so as to face each other, the localization positions of the sounds are likely to overlap in and around the intermediate position between the two speakers.

Moreover, as FIG. 21 illustrates, in the case where influences of reflection is large due to the layout in which the L-channel speaker 60 and the R-channel speaker 60R are arranged in a limited space 30, the localization positions of the sounds are likely to overlap in and around the intermediate positions between the two speakers.

In the above cases, the audio signal processing method performed by the audio signal processing device 100 is particularly effective.

Other Embodiment

Embodiment 1 has been described above as an example of the technique disclosed in the present application. However, the technique according to the present disclosure is not limited thereto, but is also applicable to other embodiments in which changes, replacements, additions, omissions, etc., are made as necessary. Different ones of the components described in Embodiment 1 above may be combined to obtain a new embodiment.

Hereinafter, other embodiments will be collectively described.

Figure 22:
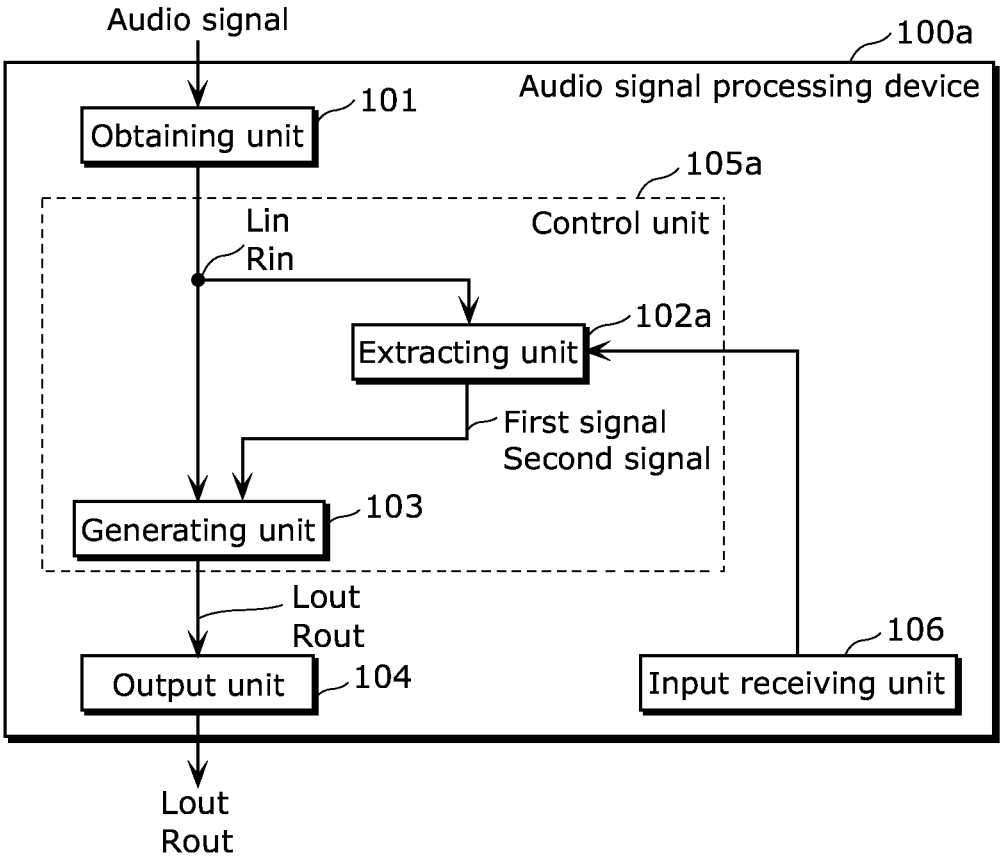
FIG. 22 is a functional block diagram illustrating a configuration of an audio signal processing device including an input receiving unit.

For example, the audio signal processing device 100 may include an input receiving unit which receives input of music genre from a user (listener). FIG. 22 is a functional block diagram illustrating a configuration of an audio signal processing device including the input receiving unit. An audio signal processing device 100*a* illustrated in FIG. 22 includes an input receiving unit 106 serving as a user interface such as a remote controller (a light receiving unit of the remote controller) and a touch panel.

As described in the above embodiment, the appropriate amount of extraction of the first signal and the second signal is different between the cases where a signal to be processed is a stereo sound source of pop music and classic music. In the audio signal processing device 100*a*, an extracting unit 102*a* (a control unit 105*a*) changes the amount of extraction of the first signal according to the music genre received by the input receiving unit 106 and changes the amount of extraction of the second signal according to the music genre received by the input receiving unit 106. Accordingly, the audio signal processing device 100*a* can appropriately change the localization position of the sound according to the music genre.

Each of the constituent elements in the above embodiment may be configured in the form of an exclusive hardware product, or may be realized by executing a software program suitable for the constituent element. The constituent elements may be implemented by a program execution unit such as a CPU or a processor which reads and executes a software program recorded on a recording medium such as a hard disk or a semiconductor memory.

For example, each constituent element may be a circuit. These circuits may form a single circuit as a whole or may alternatively form separate circuits. In addition, these circuits may each be a general-purpose circuit or may alternatively be a dedicated circuit.

These generic or specific aspects in the present disclosure may be implemented using a system, a method, an integrated circuit, a computer program, or a computer-readable recording medium such as a compact disc read only memory (CD-ROM), and may also be implemented by any combination of systems, methods, integrated circuits, computer programs, or recording media.

In the case where the audio signal processing device 100 is implemented as an integrated circuit, the obtaining unit 101 serves as an input terminal of the integrated circuit and the output unit 104 serves as an output terminal of the integrated circuit.

As examples of the technique disclosed in the present disclosure, the above embodiments have been described. For this purpose, the accompanying drawings and the detailed description have been provided.

Therefore, the constituent elements in the accompanying drawings and the detail description may include not only the constituent elements essential for solving problems, but also the constituent elements that are provided to illustrate the above described technique and are not essential for solving problems. Therefore, such inessential constituent elements should not be readily construed as being essential based on the fact that such inessential constituent elements are illustrated in the accompanying drawings or mentioned in the detailed description.

Further, the above described embodiments have been described to exemplify the technique according to the present disclosure, and therefore, various modifications, replacements, additions, and omissions may be made within the scope of the claims and the scope of the equivalents thereof.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to an audio signal processing device which can change the localization position of a sound by performing signal processing on two audio signals. For example, the present disclosure is applicable to an on-vehicle audio device, an audio reproducing device, a network audio device, and a mobile audio device. Additionally, the present disclosure may be applicable to a disc player of a Blu-ray (registered trademark) disc, DVD, hard disk and the like, a recorder, a television, a digital still camera, a digital video camera, a mobile terminal device, a personal computer, and the like.

The invention claimed is:

1. An audio signal processing method comprising:

obtaining a first audio signal and a second audio signal which represent a sound field between a first position and a second position, the first audio signal including a sound localized closer to the first position than to the second position, the second audio signal including a sound localized closer to the second position than to the first position;

extracting a first signal and a second signal, the first signal being a component of a sound included in the first audio signal and localized closer to the second position than to the first position, the second signal being a component of a sound included in the second audio signal and localized closer to the first position than to the second position;

generating (i) a first output signal by subtracting the first signal from the first audio signal and adding the second signal to the first audio signal, and (ii) a second output signal by subtracting the second signal from the second audio signal and adding the first signal to the second audio signal; and outputting the first output signal and the second output signal.

2. The audio signal processing method according to claim 1, wherein in the extracting, a first frequency signal is generated by transforming the first audio signal to a frequency domain, and a second frequency signal is generated by transforming the second audio signal to a frequency domain, the first signal in the frequency domain is extracted from the first frequency signal, the first signal is extracted by transforming the first signal in the frequency domain to a time domain, the second signal in the frequency domain is extracted from the second frequency signal, and the second signal is extracted by transforming the second signal in the frequency domain to a time domain.

3. The audio signal processing method according to claim 2, wherein in the extracting, a signal level of the first frequency signal and a signal level of the second frequency signal are compared for each of frequencies to determine, for the each of frequencies, an amount of extraction of the first signal in the frequency domain and an amount of extraction of the second signal in the frequency domain.

4. The audio signal processing method according to claim 3, wherein in the extracting, the amount of extraction of the first signal in the frequency domain is determined to be greater for a frequency in which the signal level of the first frequency signal is less than the signal level of the second frequency signal and where a difference between the signal level of the first frequency signal and the signal level of the second frequency signal is greater, and the amount of extraction of the second signal in the frequency domain is determined to be greater for a frequency in which the signal level of the second frequency signal is less than the signal level of the first frequency signal and where a difference between the signal level of the first frequency signal and the signal level of the second frequency signal is greater.

5. The audio signal processing method according to claim 4, wherein in the extracting, in a frequency of f hertz where f is a real number, when a is the signal level of the first frequency signal, b is the signal level of the second frequency signal, and k is a predetermined threshold where k is a positive real number, the amount of extraction of a component of the frequency of f hertz of the first signal in the frequency domain is determined to be b/a when $b/a \geq k$ is satisfied, and to be 0 when $b/a < k$ is satisfied, and the amount of extraction of a component of the frequency of f hertz of the second signal in the frequency domain is determined to be a/b when $a/b \geq k$ is satisfied, and to be 0 when $a/b < k$ is satisfied.

6. The audio signal processing method according to claim 1, further comprising receiving an input of a music genre from a user, wherein in the extracting, the amount of extraction of the first signal and the amount of extraction of the second signal are changed according to the music genre received in the receiving.

7. The audio signal processing method according to claim 1, wherein the first audio signal is an L signal included in a stereo signal, and the second audio signal is an R signal included in the stereo signal.

8. An audio signal processing device comprising:

an obtaining unit configured to obtain a first audio signal and a second audio signal which represent a sound field between a first position and a second position, the first audio signal including a sound localized closer to the first position than to the second position, the second audio signal including a sound localized closer to the second position than to the first position;

a control unit configured to generate a first output signal and a second output signal from the first audio signal and the second audio signal; and an output unit configured to output the first output signal and the second output signal, wherein the control unit is configured to:

extract a first signal and a second signal, the first signal being a component of a sound included in the first audio signal and localized closer to the second position than to the first position, the second signal being a component of a sound included in the second audio signal and localized closer to the first position than to the second position; and generate (i) the first output signal by subtracting the first signal from the first audio signal and adding the second signal to the first audio signal, and (ii) the second output signal by subtracting the second signal from the second audio signal and adding the first signal to the second audio signal.

* * * * *